US010654602B2

(12) United States Patent
Nakamoto

(10) Patent No.: US 10,654,602 B2
(45) Date of Patent: May 19, 2020

(54) INSERTION APPARATUS

(71) Applicant: TOYO JIDOKI CO., LTD., Tokyo (JP)

(72) Inventor: Kakue Nakamoto, Iwakuni (JP)

(73) Assignee: TOYO JIDOKI CO., LTD., Tokyo (JP)

( * ) Notice: Subject to any disclaimer, the term of this patent is extended or adjusted under 35 U.S.C. 154(b) by 196 days.

(21) Appl. No.: 15/892,573

(22) Filed: Feb. 9, 2018

(65) Prior Publication Data

US 2018/0229873 A1 Aug. 16, 2018

(30) Foreign Application Priority Data

Feb. 14, 2017 (JP) ..... 2017-025252

(51) Int. Cl.
*B65B 39/12* (2006.01)
*B65B 39/06* (2006.01)
(Continued)

(52) U.S. Cl.
CPC ..... *B65B 39/12* (2013.01); *B65B 5/067* (2013.01); *B65B 35/40* (2013.01); *B65B 39/007* (2013.01);
(Continued)

(58) Field of Classification Search
CPC ..... B65B 39/12; B65B 5/067; B65B 39/007; B65B 39/06
(Continued)

(56) References Cited

U.S. PATENT DOCUMENTS 4,047,362 A * 9/1977 Lister ..... B65B 5/067 53/572
4,492,070 A * 1/1985 Morse ..... B65B 39/007 53/438
(Continued)

FOREIGN PATENT DOCUMENTS

JP 06-144403 A 5/1994
WO 2009/157332 A1 12/2011
WO 2014/080814 A1 5/2014

OTHER PUBLICATIONS

Extended European Search Report EP Application No. 18156226.5 dated May 4, 2018.

*Primary Examiner* — Praachi M Pathak
(74) *Attorney, Agent, or Firm* — Pillsbury Winthrop Shaw Pittman, LLP

(57) ABSTRACT

An insertion apparatus for placing a packaging object in a packaging bag, includes: a bag support unit that holds the packaging bag in a state where a bag mouth of the packaging bag is opened; a transfer mechanism that places the packaging object at a supply position; a first intermediate holding unit provided to be able to ascend and descend; an elevation mechanism that elevates or lowers the first intermediate holding unit so as to place the first intermediate holding unit at a first elevation position and a second elevation position; a first placement mechanism that moves the packaging object placed at the supply position in a horizontal direction so as to place the packaging object on the first intermediate holding unit placed at the first elevation position; a horizontal movement mechanism that moves the first intermediate holding unit placed at the second elevation position in the horizontal direction so as to insert at least a part of the first intermediate holding unit in the packaging bag via the bag mouth; and a second placement mechanism that moves the packaging object, placed on the first intermediate holding
(Continued)

unit at least partially placed in the packaging bag, in the horizontal direction so as to place the packaging object outside the first intermediate holding unit and inside the packaging bag.

12 Claims, 11 Drawing Sheets

(51) Int. Cl.

| | |
|---|---|
| ***B65B 5/06*** | (2006.01) |
| ***B65B 59/00*** | (2006.01) |
| ***B65B 65/02*** | (2006.01) |
| ***B65B 35/40*** | (2006.01) |
| ***B65B 39/00*** | (2006.01) |
| ***B65B 43/28*** | (2006.01) |

(52) U.S. Cl.
CPC ..... *B65B 39/06* (2013.01); *B65B 43/28* (2013.01); *B65B 59/005* (2013.01); *B65B 65/02* (2013.01)

(58) Field of Classification Search
USPC ..... 53/447, 467, 473, 566, 570
See application file for complete search history.

(56) References Cited

U.S. PATENT DOCUMENTS

| | | | | |
|---|---|---|---|---|
| 4,899,518 | A * | 2/1990 | Beeman | B65B 25/141 53/252 |
| 5,511,364 | A * | 4/1996 | Levi | B65B 5/067 53/258 |
| 2008/0022636 | A1* | 1/2008 | Haschke | A22C 21/00 53/473 |
| 2015/0203228 | A1* | 7/2015 | Johnson | B65B 43/39 53/249 |
| 2016/0059971 | A1* | 3/2016 | Oyama | B65B 39/02 53/438 |

* cited by examiner

INSERTION APPARATUS

CROSS-REFERENCE TO RELATED APPLICATIONS

This application is based upon and claims the benefit of priority from Japanese Patent Application No. 2017-025252, filed on Feb. 14, 2017; the entire contents of which are incorporated herein by reference.

TECHNICAL FIELD

The present invention relates to an insertion apparatus for placing a packaging object in a packaging bag by moving the packaging object in a horizontal direction.

BACKGROUND ART

When a packaging object to be packaged is dropped in the vertical direction (i.e., gravity direction) into a packaging bag held in a vertical posture, the free-falling packaging object collides with the bottom of the packaging bag and accumulate at the bottom, and thus the external appearance of the package may be deteriorated or damage to the packaging object or the packaging bag may be caused by the impact at the time of the drop.

In contrast, by inserting a packaging object in a horizontal posture into a packaging bag in the horizontal direction, the packaging object can be appropriately accommodated in the packaging bag without deteriorating the appearance, as well as avoiding the damage caused by the dropping. A technology of performing the packaging while holding the packaging bag in the horizontal posture is disclosed in Japanese patent application publication No. 06-144403, for example.

SUMMARY OF INVENTION

Technical Problem

To appropriately accommodate a packaging object in a packaging bag in the horizontal posture, it is desirable to insert the packaging object into the packaging bag in a state in which the relative position between the packaging bag and the packaging object has been adjusted to a desirable position. For example, the packaging object can be placed at the center of the packaging bag by inserting the packaging object into the packaging bag in a state in which the central position of the bag mouth and the central position of the packaging object have been made to coincide with each other. However, there are cases where a height direction position of a transfer mechanism for transferring the packaging object or a height direction position where the packaging bag is supported is not adjustable and the height direction position of the packaging object before being inserted Into the packaging bag and the height direction position of the packaging bag (especially, the bag mouth) do not coincide with each other. In such cases, the packaging object cannot be inserted into the packaging bag even if the packaging object is moved simply in the horizontal direction.

Further, when the size of the packaging bag and/or the packaging object has been changed, it is necessary to adjust the relative position between the packaging bag and the packaging object. In conventional insertion apparatus, such adjustment of the relative position is made by manual operation and the manual adjustment work is troublesome.

Furthermore, there are cases where the packaging object is constituted of a plurality of pouches, for example, and the plurality of pouches arranged to adjoin each other are inserted into a packaging bag used for outer packaging. Especially, there are cases where a plurality of pouches are arranged in a packaging bag by stacking the plurality of pouches on each other in the vertical direction on a tray and moving the plurality of pouches from the tray to the inside of the packaging bag. In such cases, if the sizes of the pouches are equal to each other, the pouches stacked on each other in the height direction can be appropriately supported by the tray. However, in cases where the sizes of the pouches are different from each other, the pouches stacked on each other in the height direction cannot be supported stably on the tray and the plurality of pouches in the stacked state can collapse when vibration or external force is applied thereto.

On the other hand, there are cases where a plurality of pouches in the vertical postures are closely aligned in a horizontal direction and are supported from both sides, like sandwiching, by side face parts of a tray. In such cases, the plurality of pouches can be supported stably on the tray irrespective of whether the sizes of the pouches are equal to each other or different from each other. However, when the thickness of each pouch or the number of pouches constituting the packaging object changes, the total width (i.e., horizontal direction size) of the pouches constituting the packaging object also changes and it is necessary to change the distance between the side face parts of the tray in order to stably support the plurality of pouches with the tray. Thus, in conventional apparatus, the tray has to be replaced depending on the type, thickness and number of the pouches. Such replacement of the tray not only takes time but also is inconvenient and requires a lot of cost since multiple types of trays have to be kept in stock.

Further, in cases where multiple types of packaging bags differing in the size or shape of the bag mouth are used in an insertion apparatus equipped with a guide for stabilizing the opening shape of the bag mouth, the arrangement of the guide has to be adjusted depending on the type of the packaging bag actually used and the adjustment work takes a lot of trouble.

The present invention has been contrived in light of the above-mentioned circumstances, and an object thereof is to provide an insertion apparatus capable of appropriately placing a packaging object in a packaging bag by moving the packaging object in a horizontal direction in a state in which the height direction positions of the packaging object and the packaging bag have been made to correspond to each other.

Solution to Problem

One aspect of the present invention is directed to an insertion apparatus for placing a packaging object in a packaging bag, the insertion apparatus comprising: a bag support unit that holds the packaging bag in a state where a bag mouth of the packaging bag is opened; a transfer mechanism that places the packaging object at a supply position; a first intermediate holding unit provided to be able to ascend and descend; an elevation mechanism that elevates or lowers the first intermediate holding unit so as to place the first intermediate holding unit at a first elevation position and a second elevation position; a first placement mechanism that moves the packaging object placed at the supply position in a horizontal direction so as to place the packaging object on the first intermediate holding unit placed at the first elevation position; a horizontal movement mechanism that moves the first intermediate holding unit placed at the second elevation position in the horizontal direction so as to insert at least a part of the first intermediate holding unit in the packaging bag via the bag mouth; and a second placement mechanism that moves the packaging object, placed on the first intermediate holding unit at least partially placed in the packaging bag, in the horizontal direction so as to place the packaging object outside the first intermediate holding unit and inside the packaging bag.

Desirably, the first intermediate holding unit includes: a base support part on which the packaging object is placed; and a first side guide part and a second side guide part between which the packaging object on the base support part is arranged, distance between the first side guide part and the second side guide part in regard to a horizontal direction being adjustable, and the insertion apparatus further comprises a first distance adjustment mechanism that adjusts the distance between the first side guide part and the second side guide part according to a position of the packaging object on the base support part.

Desirably, the first side guide part and the second side guide part are arranged in such a manner that the distance between the first side guide part and the second side guide part in regard to the horizontal direction decreases with increase in distance from the supply position, and while the packaging object is moved from the supply position onto the first intermediate holding unit placed at the first elevation position, the distance between the first side guide part and the second side guide part in regard to the horizontal direction at a position closest to the supply position is larger than size of the packaging object placed at the supply position in regard to the horizontal direction, and the distance between the first side guide part and the second side guide part in regard to the horizontal direction at a position farthest from the supply position is smaller than the size of the packaging object placed at the supply position in regard to the horizontal direction.

Desirably, while the first intermediate holding unit is moved by the horizontal movement mechanism, the distance between the first side guide part and the second side guide part in regard to the horizontal direction at a position farthest from the supply position is smaller than size of the bag mouth of the packaging bag held by the bag support unit in regard to the horizontal direction, and the at least a part of the first intermediate holding unit inserted into the packaging bag by the horizontal movement mechanism includes ends of the first side guide part and the second side guide part at positions farthest from the supply position.

Desirably, the first distance adjustment mechanism biases at least one of the first side guide part and the second side guide part in a direction for making the first side guide part and the second side guide part approach each other so as to adjust the distance between the first side guide part and the second side guide part, and while the second placement mechanism moves the packaging object on the first intermediate holding unit, the first distance adjustment mechanism biases or not biases the first side guide part and the second side guide part so as to allow the packaging object to press the first side guide part and the second side guide part and increase the distance between the first side guide part and the second side guide part.

Desirably, the insertion apparatus further comprises: a second intermediate holding unit which is provided above the first intermediate holding unit and includes a third side guide part and a fourth side guide part which are provided in such a manner that the packaging object on the first intermediate holding unit placed at the second elevation position is placed between the third side guide part and the fourth side guide part and distance between the third side guide part and the fourth side guide part in regard to the horizontal direction is adjustable, and a second distance adjustment mechanism that adjusts the distance between the third side guide part and the fourth side guide part so as to regulate a position of the packaging object on the first intermediate holding unit placed at the second elevation position.

Desirably, after the first intermediate holding unit moves from the first elevation position to the second elevation position and before the at least a part of the first intermediate holding unit is inserted in the packaging bag, the second distance adjustment mechanism decreases the distance between the third side guide part and the fourth side guide part in such a manner that the third side guide part and the fourth side guide part regulate the position of the packaging object on the first intermediate holding unit.

Desirably, the packaging object includes a plurality of articles, and the plurality of articles included in the packaging object are arranged in a state of being aligned in the horizontal direction on the first intermediate holding unit.

Desirably, the second elevation position is determined according to size of the packaging object in regard to a vertical direction and a position of the bag mouth of the packaging bag held by the bag support unit in regard to the vertical direction.

According to the present invention, a packaging object can be appropriately placed in a packaging bag by moving the packaging object in a horizontal direction in the state in which the height direction positions of the packaging object and the packaging bag have been made to correspond to each other.

BRIEF DESCRIPTION OF DRAWINGS

FIG. 11A shows a state just before the first intermediate holding unit and the second intermediate holding unit are inserted into a packaging bag, FIG. 11B shows a state just after the first intermediate holding unit and the second intermediate holding unit are inserted into the packaging bag, and FIG. 11C shows a state just after a packaging object is pushed out by a second pushing member to the inside of the packaging bag.

DESCRIPTION OF EMBODIMENTS

Figure 1:
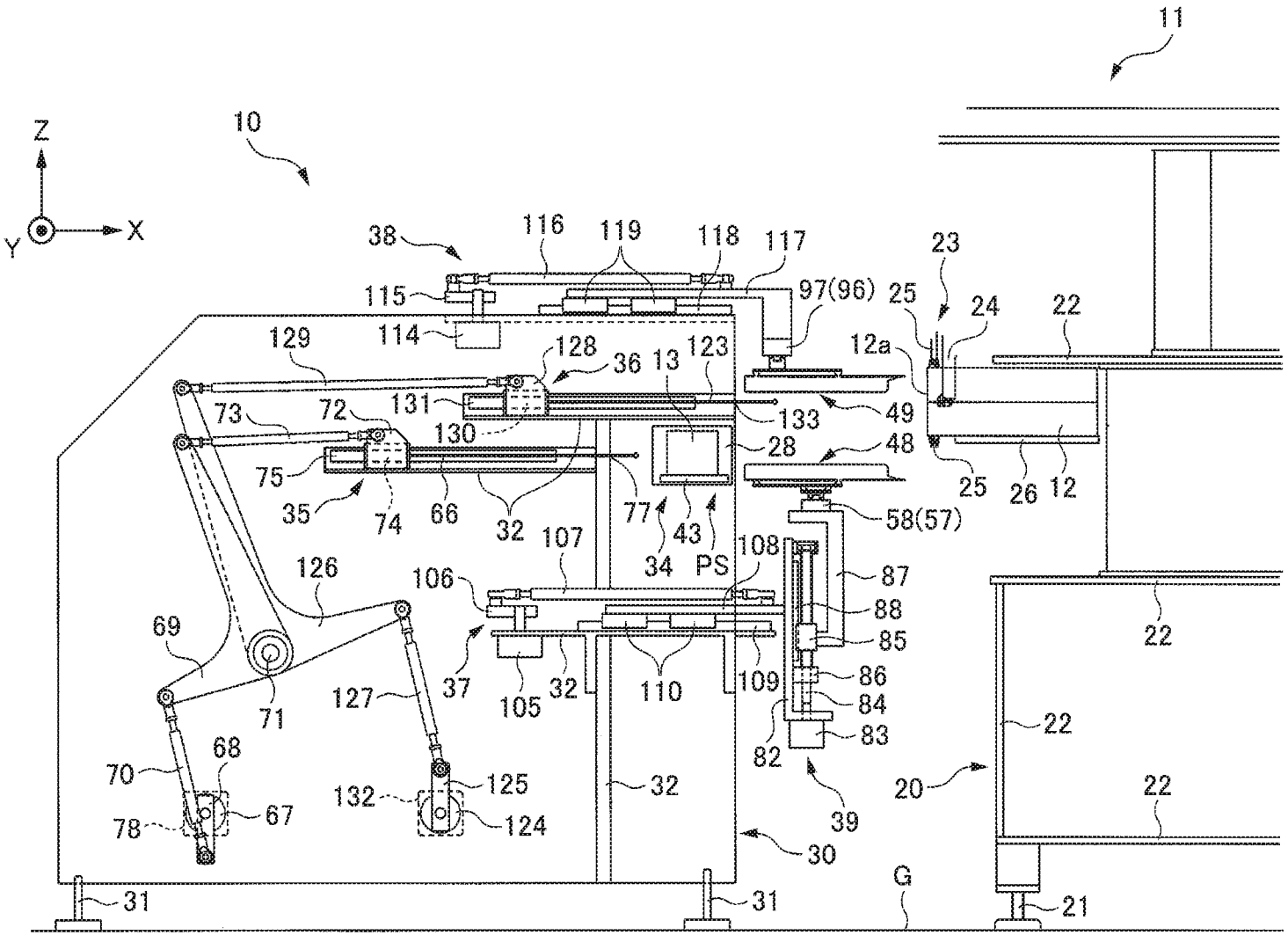
FIG. 1 is a schematic diagram showing the overall configuration of an insertion apparatus and a packaging machine according to an embodiment of the present invention.

An embodiment of the present invention will be described below with reference to drawings. While the sizes of elements and reduction scales between the elements indicated in the drawings do not necessarily coincide with each other between drawings or coincide with the size reduction scales of the actual elements in order to facilitate the understanding, those skilled in the art are supposed to properly figure out the sizes and reduction scales of the elements.

FIG. 1 is a schematic diagram showing the overall configuration of an insertion apparatus 10 and a packaging machine 11 according to an embodiment of the present invention.

The insertion apparatus 10 shown in FIG. 1 is used for the packaging machine 11 that packages a packaging object 13 in a packaging bag 12 whose bag mouth 12*a* has been pointed in a horizontal direction (so-called "horizontal bagging packaging machine"). Therefore, the insertion apparatus 10 moves the packaging object 13 in a horizontal direction opposite to the former horizontal direction and arranges the packaging object 13 in the packaging bag 12 via the bag mouth 12*a* pointed in the former horizontal direction.

While details of the operation flow of the insertion apparatus 10 will be described later, the outline of the operation flow is as follows: First, the packaging object 13 on a transfer belt 43 is transferred in a horizontal direction, the packaging object 13 is placed on a first intermediate holding unit 48 that has been placed at a first elevation position, and the first intermediate holding unit 48 ascends from the first elevation position to a second elevation position together with the packaging object 13. Then, a second intermediate holding unit 49 and the first intermediate holding unit 48 placed at the second elevation position, in a state of holding the packaging object 13, move in a horizontal direction and are inserted into the packaging bag 12. Thereafter, the packaging object 13 is pushed out from the position on the first intermediate holding unit 48 to the inside of the packaging bag 12 outside the first intermediate holding unit 48. By the above series of steps, the packaging object 13 is transferred from the position on the transfer belt 43 to the inside of the packaging bag 12.

Incidentally, the type and configuration of the packaging object 13 are not particularly limited. Thus, each packaging object 13 may either be constituted of a single article or include a plurality of articles, and the arrangement of the plurality of articles is also not particularly limited. In the insertion apparatus 10 of this embodiment, the widths of the first intermediate holding unit 48 and the second intermediate holding unit 49 in the horizontal direction (i.e., Y direction) are variable as will be explained later, and thus the plurality of articles constituting each packaging object 13 are desired to be arranged in a state of being aligned in the horizontal direction (i.e., Y direction). The following explanation will be given of a case where each packaging object 13 is constituted of a plurality of (specifically, three) pouches 14 (see FIG. 2) and the insertion apparatus 10 and the packaging machine 11 perform the packaging by inserting three pouches 14 into one packaging bag 12 in a lump.

Here, "a single article" means an object having an integral configuration, while "a plurality of articles" means a plurality of objects physically separated and not connected to each other. Incidentally, the mode of arrangement of "a plurality of articles" is not particularly limited; the plurality of articles may be arranged with a distance between each other, or part or all of the plurality of articles may be in contact with an adjoining article.

[Packaging Machine]

A mount 20 of the packaging machine 11 is fixed on the ground G via a plurality of legs 21. The mount 20 is configured as a frame and functions as a base supporting the members constituting the packaging machine 11. A plurality of support plates 22 extending in various directions are fixed to the mount 20. Part or all of the members constituting the packaging machine 11 are directly attached to the mount 20, or indirectly attached to the mount 20 via a support plate 22.

A bag support unit 23 supported by the mount 20 includes a pair of grippers 24 for gripping both side edge parts of the packaging bag 12, a pair of suction cups 25 for sucking and holding a front side outer surface and a back side outer surface of the packaging bag 12, and a bag holding member 26 for supporting the back side outer surface of the packaging bag 12 from below. The pair of grippers 24 is provided to be movable in the horizontal direction (i.e., Y direction) so as to approach and separate from each other. The pair of suction cups 25 is provided to be movable in a height direction (i.e., Z direction) so as to approach and separate from each other. The bag holding member 26 is provided basically in a stationary manner, but its height direction position and horizontal direction position can be changed by a position adjustment mechanism that is not illustrated. In addition to the function of supporting the packaging bag 12, the bag holding member 26 also has a function of supporting the packaging object 13 placed in the packaging bag 12 and thereby prevents the deterioration in the appearance of the packaging bag 12 in which the packaging object 13 has been placed (see FIG. 10).

When a series of steps for inserting the packaging object 13 into the packaging bag 12 which will be explained later is carried out, the bag support unit 23 including the pair of grippers 24, the pair of suction cups 25 and the bag holding member 26 holds the packaging bag 12 with its bag mouth 12*a* open and pointed in the horizontal direction (i.e., X direction).

In this embodiment, a plurality of bag support units 23 are provided so that each bag support unit 23 is movable. Each bag support unit 23 moves to the next stage after the insertion of the packaging object 13 into the packaging bag 12 is carried out at the position shown in FIG. 1, and the next bag support unit 23 supporting another packaging bag 12 containing no packaging object 13 inserted therein is placed at the position shown in FIG. 1. By repeating the insertion of the packaging object 13 and the placement of another packaging bag 12 described above, the insertion of the packaging objects 13 into the packaging bags 12 is carried out continuously.

[Insertion Apparatus]

A mount 30 of the insertion apparatus 10 is fixed on the ground G via a plurality of legs 31. The mount 30 is configured as a frame and functions as a base supporting the members constituting the insertion apparatus 10. A plurality of support plates 32 extending in various directions are fixed to the mount 30. Part or all of the members constituting the insertion apparatus 10 are directly attached to the mount 30, or indirectly attached to the mount 30 via a support plate 32.

The Insertion apparatus 10 mainly includes a transfer mechanism 34, the first intermediate holding unit 48, a first pushing mechanism 35, an elevation mechanism 39, a first horizontal movement mechanism 37, a second horizontal movement mechanism 38 and a second pushing mechanism 36. The transfer mechanism 34 transfers the packaging object 13 to a supply position PS. The first intermediate holding unit 48 is provided to be able to ascend and descend. The first pushing mechanism 35 pushes out the packaging object 13 placed at the supply position PS from the position on the transfer mechanism 34 onto the first intermediate holding unit 48. The elevation mechanism 39 moves the first intermediate holding unit 48 up and down. The first horizontal movement mechanism 37 inserts the first intermediate holding unit 48 into the packaging bag 12. The second horizontal movement mechanism 38 inserts the second intermediate holding unit 49 into the packaging bag 12. The second pushing mechanism 36 pushes out the packaging object 13 placed on the first intermediate holding unit 48 into the packaging bag 12 outside the first intermediate holding unit 48. The specific configuration of each of these devices will be described below.

[Transfer Mechanism]

The transfer mechanism 34 includes the transfer belt 43 on which a plurality of packaging objects 13 are set. The transfer belt 43, with the plurality of packaging objects 13 set thereon, travels in the horizontal direction (i.e., Y direction) and makes each packaging object 13 stop at the supply position PS shown in FIG. 1. The transfer belt 43 repeats the traveling and the stoppage intermittently. The packaging object 13 is transferred from the supply position PS while the transfer belt 43 is stopped. Thereafter, a new packaging object 13 is placed at the supply position PS by the traveling and the stoppage of the transfer belt 43. The traveling and the stoppage of the transfer belt 43 described above are performed under the control of a control unit (see FIG. 5 which will be explained later).

Figure 2:
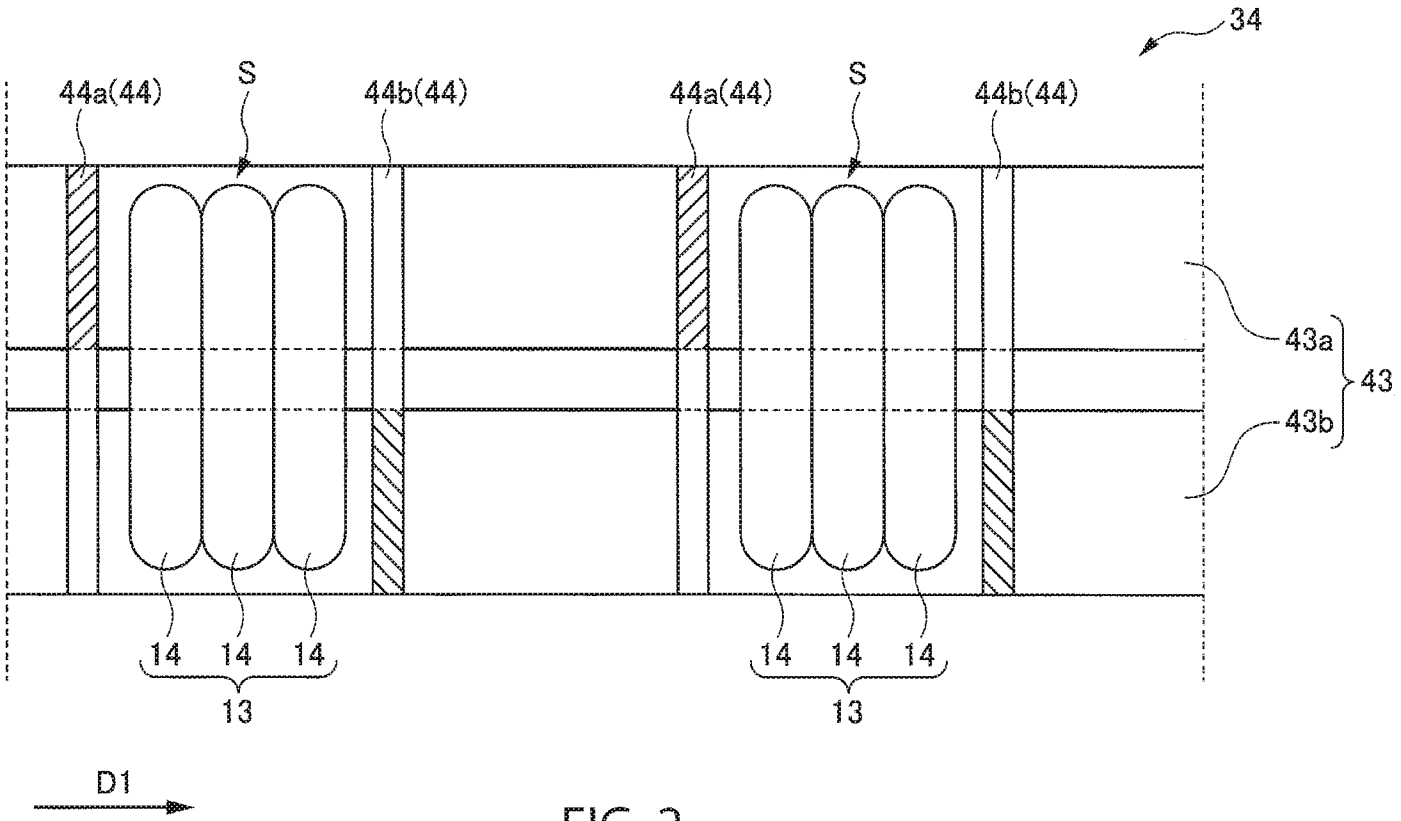
FIG. 2 is an enlarged plan view showing an example of a transfer belt.

FIG. 2 is an enlarged plan view showing an example of the transfer belt 43.

The transfer belt 43 shown in FIG. 2 is separated into a first transfer belt 43*a* and a second transfer belt 43*b*. The first transfer belt 43*a* and the second transfer belt 43*b* are arranged at positions adjoining each other across a gap, and travel with a plurality of packaging objects 13 (i.e., a plurality of pouches 14) set thereon in the same transfer direction D1 (i.e., Y direction) and at the same speed.

On the transfer belt 43, a plurality of side guides 44, demarcating spaces S in each of which a packaging object 13 is placed, are provided at positions separate from each other in regard to the transfer direction D1. Each side guide 44, extending in a horizontal direction (i.e., X direction) orthogonal to the transfer direction D1, is arranged to straddle both the first transfer belt 43*a* and the second transfer belt 43*b*. Each of the plurality of side guides 44 is fixed to only one of the first transfer belt 43*a* and the second transfer belt 43*b* (see the hatched areas in FIG. 2), and two side guides 44 arranged to adjoin each other in regard to the transfer direction D1 are each fixed to transfer belts different from each other. Namely, side guides 44*a* fixed to the first transfer belt 43*a* and side guides 44*b* fixed to the second transfer belt 43*b* are arranged alternately in regard to the transfer direction D1.

Each side guide 44 supports a packaging object 13 on the transfer belt 43 from the side and thereby prevents the posture of the packaging object 13 on the transfer belt 43 from being disturbed. Incidentally, while each side guide 44 does not necessarily have to be in contact with the packaging object 13 on the transfer belt 43, each side guide 44 regulates the position of the packaging object 13 so as to prevent an extreme change in the posture of the packaging object 13. On the transfer belt 43 shown in FIG. 2, three pouches 14 in the vertical posture are arranged in the state of being aligned in the horizontal direction (i.e., transfer direction D1). The transfer belt 43 repeats the traveling and the stoppage in the transfer direction D1 while supporting the three pouches 14 between two side guides 44. Incidentally, the supply of the packaging objects 13 onto the transfer belt 43 is carried out on the upstream side of the supply position PS shown in FIG. 1, in which the packaging objects 13 are successively arranged in the spaces S on the transfer belt 43 by a device or human hands.

With the transfer mechanism 34 shown in FIG. 2, the size of the space S demarcated by two side guides 44 arranged to adjoin each other (i.e., the size in regard to the transfer direction D1) can be adjusted with ease just by changing the relative position between the first transfer belt 43*a* and the second transfer belt 43*b*. For example, in cases of transferring packaging objects 13 whose size in regard to the transfer direction D1 is larger than normal, it is sufficient to increase the distance between the side guides 44, demarcating each space S in which a packaging object 13 is placed, according to the size of the packaging object 13 by changing the relative position between the first transfer belt 43*a* and the second transfer belt 43*b*. In cases of transferring packaging objects 13 whose size in regard to the transfer direction D1 is smaller than normal, it is sufficient to decrease the distance between the side guides 44, demarcating each space S in which a packaging object 13 is placed, according to the size of the packaging object 13 by changing the relative position between the first transfer belt 43*a* and the second transfer belt 43*b*. As above, the transfer mechanism 34 shown in FIG. 2 is capable of easily and flexibly handling packaging objects 13 of various sizes.

The transfer belt 43 and the side guides 44 described above are provided to be able to freely pass through a passage hole 28 (see FIG. 1) formed in the mount of the insertion apparatus 10 together with the packaging objects 13. Accordingly, the packaging objects 13 are transferred smoothly without interfering with the insertion apparatus 10.

Incidentally, the transfer mechanism 34 shown in FIG. 2 is just an example and the specific configuration of the transfer mechanism 34 is not particularly limited. For example, it is possible to transfer the packaging objects 13 and successively place the packaging objects 13 at the supply position PS by use of a transfer mechanism disclosed in JP-1994-144403A.

[First Intermediate Holding Unit and First Distance Adjustment Mechanism]

The first intermediate holding unit 48 is provided to be able to ascend and descend in the height direction (i.e., Z direction) between the first elevation position for receiving the packaging object 13 from the transfer belt 43 (i.e., lower position) and the second elevation position for inserting the packaging object 13 into the packaging bag 12 (i.e., upper position).

The height direction position of the first intermediate holding unit 48 placed at the first elevation position is substantially the same as that of the transfer belt 43 shown in FIG. 1. A mount surface (i.e., upper surface of a base support part 51 which will be explained later) of the first intermediate holding unit 48 placed at the first elevation position is desired to be arranged at the same height direction position as an upper surface of the transfer belt 43 at the supply position PS or at a position slightly lower than the upper surface of the transfer belt 43. With this arrangement, the packaging object 13 pushed out from the transfer belt 43 can be smoothly set on the first intermediate holding unit 48. On the other hand, the first intermediate holding unit 48 placed at the second elevation position (see FIG. 8 which will be explained later) is situated at a height direction position at which the first intermediate holding unit 48 moving in the horizontal direction can enter the inside of the packaging bag 12 via the bag mouth 12*a* without interfering with the packaging bag 12 supported by the bag support unit 23.

Incidentally, the second elevation position is determined according to the size of the packaging object 13 in the vertical direction (i.e., Z direction) and the vertical direction position of the bag mouth 12*a* of the packaging bag 12 held by the bag support unit 23. The second elevation position is determined so that the packaging object 13 can be appropriately supported by the second intermediate holding unit 49 and the first intermediate holding unit 48 placed at the second elevation position and the second intermediate holding unit 49 and the first intermediate holding unit 48 placed at the second elevation position can smoothly enter the inside of the packaging bag 12 held by the bag support unit 23 via the bag mouth 12*a* when the second intermediate holding unit 49 and the first intermediate holding unit 48 move in the horizontal direction. The second elevation position may either be determined by an operator or determined by the control unit (see FIG. 5 which will be explained later) based on data (e.g., vertical direction size data of the packaging object 13 and vertical direction position data of the bag mouth 12*a* of the packaging bag 12 held by the bag support unit 23) inputted to the control unit by the operator.

Figure 3C:
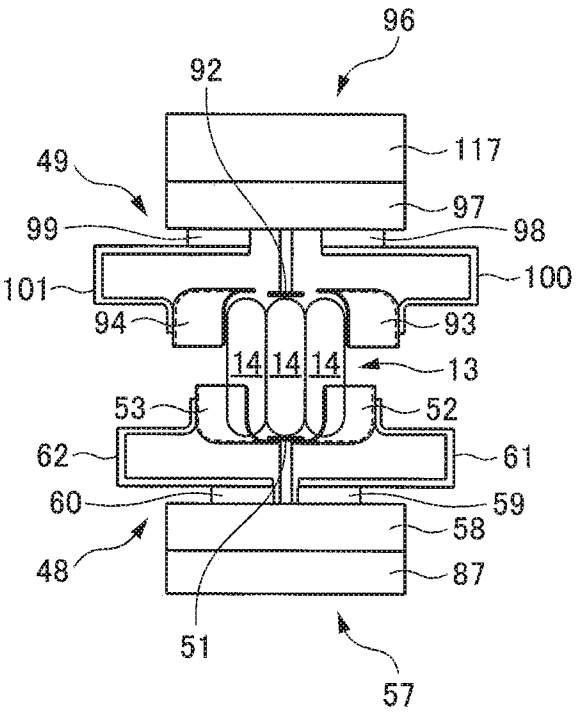
FIG. 3C is a front view showing a first intermediate holding unit, a second intermediate holding unit, a first distance adjustment mechanism and a second distance adjustment mechanism, and in particular, shows a state in which the first intermediate holding unit is arranged at the closed position and the second intermediate holding unit is arranged at the open position.
Figure 3B:
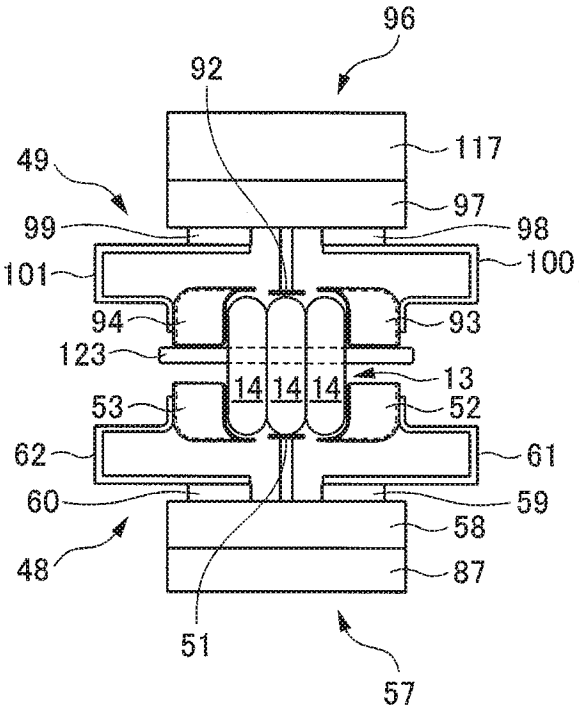
FIG. 3B is a front view showing a first intermediate holding unit, a second intermediate holding unit, a first distance adjustment mechanism and a second distance adjustment mechanism, and in particular, shows a state in which the first intermediate holding unit and the second intermediate holding unit are arranged at open positions.
Figure 3A:
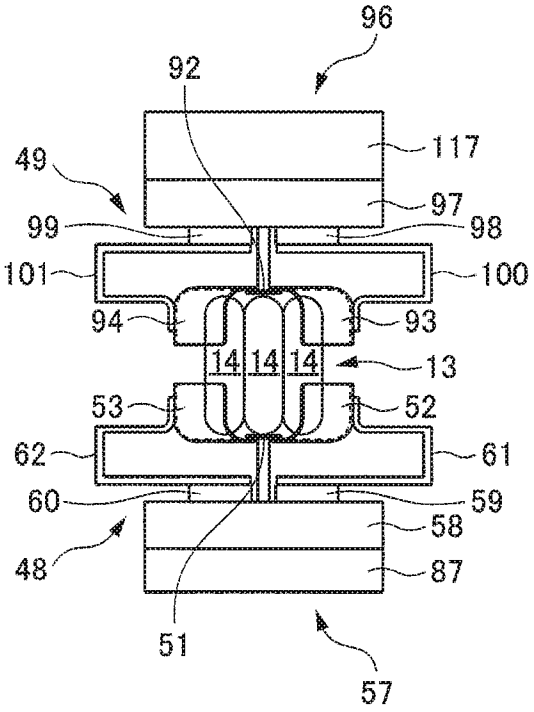
FIG. 3A is a front view showing a first intermediate holding unit, a second intermediate holding unit, a first distance adjustment mechanism and a second distance adjustment mechanism, and in particular, shows a state in which the first intermediate holding unit and the second intermediate holding unit are arranged at closed positions.

FIGS. 3A to 3C are front views showing the first intermediate holding unit 48, the second intermediate holding unit 49, a first distance adjustment mechanism 57 and a second distance adjustment mechanism 96, where FIG. 3A shows a state in which the first intermediate holding unit 48 and the second intermediate holding unit 49 are arranged at closed positions, FIG. 3B shows a state in which the first intermediate holding unit 48 and the second intermediate holding unit 49 are arranged at open positions, and FIG. 3C shows a state in which the first intermediate holding unit 48 is arranged at the closed position and the second intermediate holding unit 49 is arranged at the open position. Incidentally, FIGS. 3A to 3C illustrate states in which the first intermediate holding unit 48 is placed at the second elevation position and the first intermediate holding unit 48 and the second intermediate holding unit 49 are arranged at positions close to each other.

The first intermediate holding unit 48 in this embodiment includes a base support part 51 on which the packaging object 13 is set and a first side guide part 52 and a second side guide part 53 between which the packaging object 13 on the base support part 51 is placed. One lower tray is formed by the combination of these three parts constituting the first intermediate holding unit 48. On the base support part 51, the three pouches 14 constituting the packaging object 13 are arranged in the vertical postures in the state of being aligned in the horizontal direction (i.e., Y direction). The first side guide part 52 and the second side guide part 53, as members for supporting the packaging object 13 on the base support part 51 from both sides, are arranged at positions symmetrical to each other with respect to the base support part 51 as the center, and are provided so that the distance between each other in regard to the horizontal direction (i.e., Y direction) is adjustable.

Incidentally, the base support part 51, the first side guide part 52 and the second side guide part 53 in this embodiment have planar shapes similar to those of a top plate part 92, a third side guide part 93 and a fourth side guide part 94, respectively, of the second intermediate holding unit 49 shown in FIG. 4 which will be explained later. Specifically, the first side guide part 52 and the second side guide part 53 in this embodiment are arranged so that the distance between the first side guide part 52 and the second side guide part 53 in regard to the horizontal direction (i.e., Y direction) decreases with the increase in the distance from the supply position PS.

The first distance adjustment mechanism 57 adjusts the distance between the first side guide part 52 and the second side guide part 53 according to the position of the packaging object 13 on the base support part 51. Namely, the distance between the first side guide part 52 and the second side guide part 53 is variable according to the position of the packaging object 13 on the base support part 51. The first side guide part 52 and the second side guide part 53 appropriately support the packaging object 13 from both sides or appropriately regulate the lateral position (i.e., Y direction position) of the packaging object 13 irrespective of the position (especially, the X direction position) of the packaging object 13 on the base support part 51. Specifically, as shown in FIGS. 3A to 3C, the first distance adjustment mechanism 57 includes a first air cylinder 58, an unshown compressed air port for having the first air cylinder 58 operate, and a first movable unit 59 and a second movable unit 60 that are moved in the horizontal direction (i.e., Y direction) by the first air cylinder 58. The first air cylinder 58 operates according to supply of air from the compressed air port and discharge of air via the compressed air port, moves the first movable unit 59 and the second movable unit 60 in the horizontal direction (i.e., Y direction), and adjusts the distance between the first movable unit 59 and the second movable unit 60.

The first side guide part 52 and the second side guide part 53 are respectively attached to the first movable unit 59 and the second movable unit 60 via a first attachment plate 61 and a second attachment plate 62, and move in the horizontal direction (i.e., Y direction) together with the first movable unit 59 and the second movable unit 60. The first movable unit 59 and the second movable unit 60 move symmetrically with respect to the base support part 51 as the center, and the first side guide part 52 and the second side guide part 53 also move symmetrically with respect to the base support part 51 as the center. Incidentally, the base support part 51 is fixed to the first air cylinder 58 and is not moved in the horizontal direction by the first air cylinder 58.

The first distance adjustment mechanism 57 in this embodiment (i.e., the first air cylinder 58) adjusts the distance between the first movable unit 59 and the second movable unit 60 by biasing the first movable unit 59 and the second movable unit 60 in directions for making them approach each other. Namely, the first distance adjustment mechanism 57 adjusts the distance between the first side guide part 52 and the second side guide part 53 by biasing at least one (in this embodiment, each) of the first side guide part 52 and the second side guide part 53 in a direction for making the first side guide part 52 and the second side guide part 53 approach each other.

The first side guide part 52 and the second side guide part 53 arranged at closed positions as the result of approaching each other (see FIGS. 3A and 3C) support the packaging object 13 placed on the base support part 51 from both sides. Incidentally, while the first side guide part 52 and the second side guide part 53 arranged at the closed positions do not necessarily have to be in contact with the packaging object 13 on the base support part 51, the first side guide part 52 and the second side guide part 53 at the closed positions regulate the position of the packaging object 13 so as to prevent an extreme change in the posture of the packaging object 13.

While the packaging object 13 is moved from the supply position PS onto the first intermediate holding unit 48 placed at the first elevation position, the first side guide part 52 and the second side guide part 53 are arranged as follows: Specifically, the distance between the first side guide part 52 and the second side guide part 53 in the horizontal direction (i.e., Y direction) at the position closest to the supply position PS is larger than the horizontal direction size of the packaging object 13 placed at the supply position PS. Further, the distance between the first side guide part 52 and the second side guide part 53 in the horizontal direction (i.e., Y direction) at the position farthest from the supply position PS is smaller than the horizontal direction size of the packaging object 13 placed at the supply position PS.

While the first intermediate holding unit 48 is moved by the first horizontal movement mechanism 37 towards the inside of the packaging bag 12, the first side guide part 52 and the second side guide part 53 are arranged as follows: Specifically, the width (especially, the width of outer parts) of the first side guide part 52 and the second side guide part 53 in the horizontal direction (i.e., Y direction) at the position farthest from the supply position PS is smaller than the horizontal direction size of the bag mouth 12*a* of the packaging bag 12 held by the bag support unit 23. Incidentally, at least a part of the first intermediate holding unit 48 inserted into the packaging bag 12 by the first horizontal movement mechanism 37 includes ends of the first side guide part 52 and the second side guide part 53 at positions farthest from the supply position PS.

Further, while the second pushing mechanism 36 moves the packaging object 13 on the first intermediate holding unit 48, the first side guide part 52 and the second side guide part 53 are arranged as follows: Specifically, the first distance adjustment mechanism 57 biases or not biases the first side guide part 52 and the second side guide part 53 so as to allow the packaging object 13 to press the first side guide part 52 and the second side guide part 53 outward and increase the distance between the first side guide part 52 and the second side guide part 53.

[Second Intermediate Holding Unit and Second Distance Adjustment Mechanism]

Figure 4:
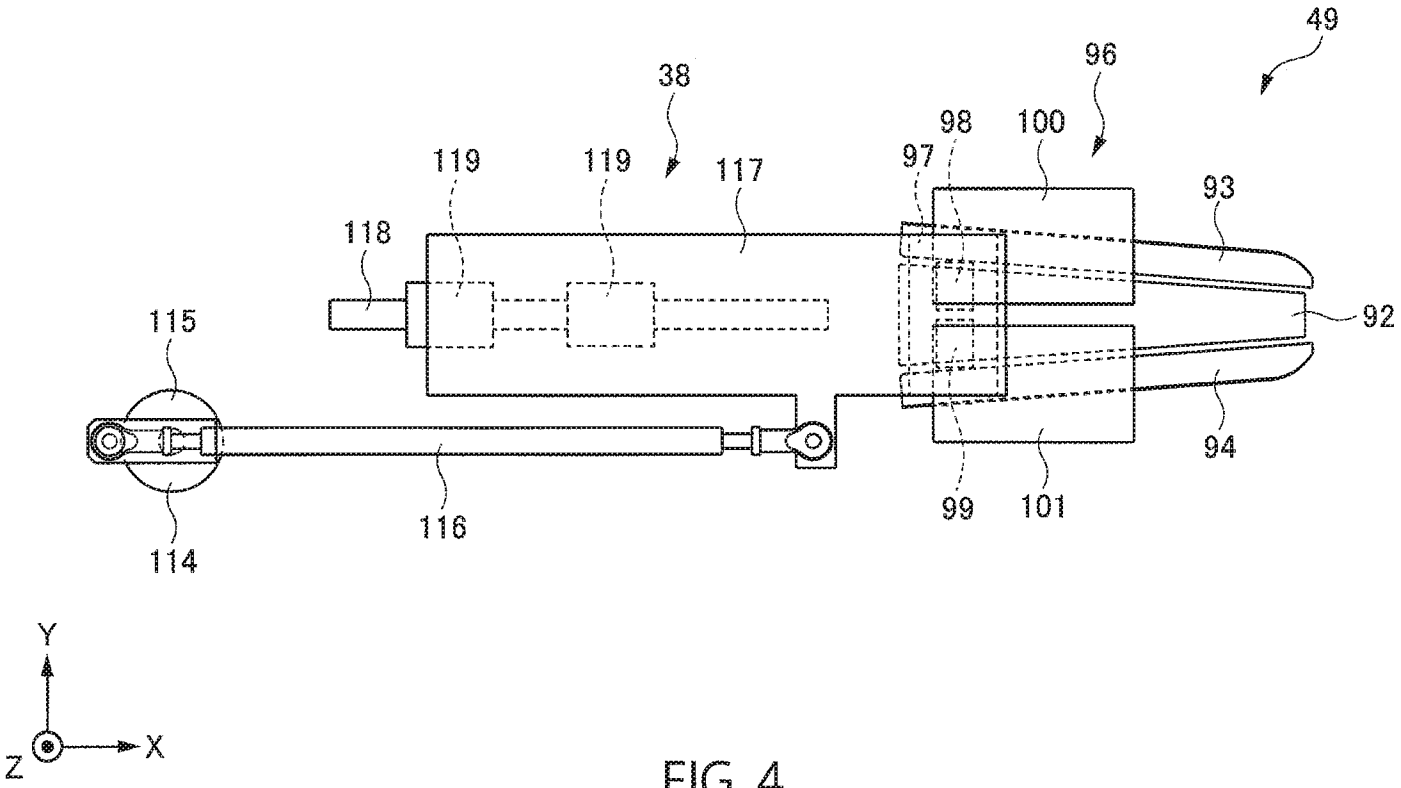
FIG. 4 is a plan view showing the second intermediate holding unit, the second distance adjustment mechanism and a second horizontal movement mechanism.

FIG. 4 is a plan view showing the second intermediate holding unit 49, the second distance adjustment mechanism 96 and the second horizontal movement mechanism 38. The second intermediate holding unit 49 and the second distance adjustment mechanism 96 basically have configurations similar to the first intermediate holding unit 48 and the first distance adjustment mechanism 57 described above.

The second intermediate holding unit 49 is provided above the first intermediate holding unit 48 in regard to the height direction. The second intermediate holding unit 49 in this embodiment includes a top plate part 92 that regulates a top position of the packaging object 13 in regard to the height direction and a third side guide part 93 and a fourth side guide part 94 for supporting the packaging object 13 on the base support part 51 from both sides. One upper tray is formed by the combination of these three parts constituting the second intermediate holding unit 49. The top plate part 92 is sandwiched between the third side guide part 93 and the fourth side guide part 94. The third side guide part 93 and the fourth side guide part 94 are arranged at positions symmetrical to each other with respect to the top plate part 92 as the center. The third side guide part 93 and the fourth side guide part 94 are provided so that the packaging object 13 on the first intermediate holding unit 48 placed at the second elevation position is placed between each other and the distance between each other in regard to the horizontal direction is adjustable.

Incidentally, the top plate part 92 may either be in contact with the packaging object 13 or not in contact with the packaging object 13 as long as the top plate part 92 can regulate the top position of the packaging object 13 on the base support part 51 of the first intermediate holding unit 48 placed at the second elevation position. From the viewpoint of smoothly pushing out the packaging object 13 from the position on the base support part 51 into the packaging bag 12 as will be described later, the top plate part 92 is desired to be situated at a position separate from the packaging object 13 on the first intermediate holding unit 48 placed at the second elevation position.

Incidentally, the third side guide part 93 and the fourth side guide part 94 in this embodiment are arranged so that the distance between the third side guide part 93 and the fourth side guide part 94 in regard to the horizontal direction (i.e., Y direction) decreases with the increase in the distance from the supply position PS.

The second distance adjustment mechanism 96 for adjusting the distance between the third side guide part 93 and the fourth side guide part 94 includes a second air cylinder 97, an unshown compressed air port for having the second air cylinder 97 operate, and a third movable unit 98 and a fourth movable unit 99 that are moved in the horizontal direction (i.e., Y direction) by the second air cylinder 97. The second air cylinder 97 is capable of adjusting the distance between the third movable unit 98 and the fourth movable unit 99 by moving the third movable unit 98 and the fourth movable unit 99 in the horizontal direction (i.e., Y direction) according to supply of air from the compressed air port and discharge of air via the compressed air port.

The third side guide part 93 and the fourth side guide part 94 are respectively attached to the third movable unit 98 and the fourth movable unit 99 via a third attachment plate 100 and a fourth attachment plate 101, and move in the horizontal direction (i.e., Y direction) together with the third movable unit 98 and the fourth movable unit 99. The third movable unit 98 and the fourth movable unit 99 move symmetrically with respect to the top plate part 92 as the center, and the third side guide part 93 and the fourth side guide part 94 also move symmetrically with respect to the top plate part 92 as the center. Incidentally, the top plate part 92 is fixed to the second air cylinder 97 and is not moved in the horizontal direction by the second air cylinder 97.

The second distance adjustment mechanism 96 adjusts the distance between the third side guide part 93 and the fourth side guide part 94 so as to regulate the position of the packaging object 13 on the first intermediate holding unit 48 placed at the second elevation position. The second distance adjustment mechanism 96 in this embodiment (i.e., the second air cylinder 97) adjusts the distance between the third movable unit 98 and the fourth movable unit 99 by biasing the third movable unit 98 and the fourth movable unit 99 in directions for making them approach each other. Namely, the second distance adjustment mechanism 96 adjusts the distance between the third side guide part 93 and the fourth side guide part 94 by biasing at least one (in this embodiment, each) of the third side guide part 93 and the fourth side guide part 94 in a direction for making the third side guide part 93 and the fourth side guide part 94 approach each other.

The third side guide part 93 and the fourth side guide part 94 arranged at closed positions as the result of approaching each other (see FIG. 3A) support the packaging object 13 placed on the base support part 51 from both sides. Incidentally, while the third side guide part 93 and the fourth side guide part 94 arranged at the closed positions do not necessarily have to be in contact with the packaging object 13 on the base support part 51, the third side guide part 93 and the fourth side guide part 94 at the closed positions regulate the position of the packaging object 13 so as to prevent an extreme change in the posture of the packaging object 13.

While the first intermediate holding unit 48 ascends from the first elevation position to the second elevation position together with the packaging object 13, the third side guide part 93 and the fourth side guide part 94 are arranged as follows: Specifically, the third side guide part 93 and the fourth side guide part 94 are arranged so as to secure a distance between each other sufficient for avoiding contact with the packaging object 13 on the first intermediate holding unit 48.

After the first intermediate holding unit 48 has moved from the first elevation position to the second elevation position and before at least a part of the first intermediate holding unit 48 is inserted into the packaging bag 12, the second distance adjustment mechanism 96 decreases the distance between the third side guide part 93 and the fourth side guide part 94 so that the third side guide part 93 and the fourth side guide part 94 regulate the position of the packaging object 13 on the first intermediate holding unit 48.

While the second intermediate holding unit 49 is moved by the second horizontal movement mechanism 38 towards the inside of the packaging bag 12, the third side guide part 93 and the fourth side guide part 94 are arranged as follows: Specifically, the width (especially, the width of outer parts) of the third side guide part 93 and the fourth side guide part 94 in the horizontal direction (i.e., Y direction) at the position farthest from the supply position PS is smaller than the horizontal direction size of the bag mouth 12*a* of the packaging bag 12 held by the bag support unit 23. Incidentally, at least a part of the second intermediate holding unit 49 inserted into the packaging bag 12 by the second horizontal movement mechanism 38 includes ends of the third side guide part 93 and the fourth side guide part 94 at positions farthest from the supply position PS.

While the second pushing mechanism 36 moves the packaging object 13 on the first intermediate holding unit 48, the third side guide part 93 and the fourth side guide part 94 are arranged as follows: Specifically, the second distance adjustment mechanism 96 biases or not biases the third side guide part 93 and the fourth side guide part 94 so as to allow the packaging object 13 to press the third side guide part 93 and the fourth side guide part 94 outward and increase the distance between the third side guide part 93 and the fourth side guide part 94.

[First Pushing Mechanism]

The first pushing mechanism 35 functions as a first placement mechanism that moves the packaging object 13, after being placed at the supply position PS by the transfer mechanism 34, in the horizontal direction (i.e., X direction) and thereby places the packaging object 13 on the first intermediate holding unit 48 placed at the first elevation position. The first pushing mechanism 35 shown in FIG. 1 includes a first pushing member 66, a first motor 67, a first pivot block 68, a first lever 69, a first motor/lever connection rod 70, a first movement block 72, a first lever/block connection rod 73, a first slide block 74 and a first rail 75.

The first pushing member 66 is a member for making contact with the packaging object 13 on the transfer belt 43 placed at the supply position PS and pushing out the packaging object 13 from the position on the transfer belt 43 onto the first intermediate holding unit 48. The first pushing member 66 is provided to be able to reciprocate in the horizontal direction (i.e., X direction) between a withdrawn position (see FIG. 6) separate from the packaging object 13 placed at the supply position PS and a pushing position (see FIG. 7) for contacting the packaging object 13 on the first intermediate holding unit 48. The first pushing member 66 is provided to pass through a through hole 77 formed in the support plate 32, and thus the first pushing member 66 does not interfere with the support plate 32 even when reciprocating in the horizontal direction.

The first motor 67 is fixed to the mount 30 via a first motor attachment plate 78 and is connected to the first motor/lever connection rod 70 via the first pivot block 68. The first motor 67, as the drive source for the first pushing member 66, transmits motive power to the first lever 69 via the first pivot block 68 and the first motor/lever connection rod 70. The first pivot block 68 is provided stationarily with respect to a rotary shaft of the first motor 67 and is pivotably connected to the first motor/lever connection rod 70. The first motor/lever connection rod 70 is pivotably attached to the first pivot block 68 and the first lever 69. The first lever 69 is provided to be pivotable around a pivot shaft 71 and transmits the motive power supplied from the first motor 67 to the first movement block 72 via the first lever/block connection rod 73. The first lever/block connection rod 73 is pivotably attached to the first lever 69 and the first movement block 72. The first movement block 72 is fixed to the first slide block 74, and the first pushing member 66 is attached to the first slide block 74, and thus the first movement block 72, the first slide block 74 and the first pushing member 66 integrally reciprocate in the horizontal direction (i.e., X direction). The first slide block 74 is provided to be slidable along the first rail 75 extending in the horizontal direction (i.e., X direction); however, movement of the first slide block 74 in other directions (e.g., the Y direction and the Z direction) is restricted. The first rail 75 is fixed to the support plate 32.

In the first pushing mechanism 35 having the configuration described above, the pivoting state of the first lever 69 around the pivot shaft 71 is changed by the motive power outputted from the first motor 67, and the position of the first pushing member 66 in regard to the horizontal direction (i.e., X direction) can be changed according to the pivoting state of the first lever 69. Incidentally, the rotating state of the rotary shaft of the first motor 67 (including the rotation angle) is controlled by the control unit (see FIG. 5 which will be explained later), and the pivoting state of the first lever 69 and the position of the first pushing member 66 are regulated by the control unit.

[Elevation Mechanism]

The elevation mechanism 39 places the first intermediate holding unit 48 at the first elevation position and at the second elevation position by moving the first intermediate holding unit 48 up and down. The elevation mechanism 39 shown in FIG. 1 includes a fixation plate 82 fixed to the support plate 32 via the first horizontal movement mechanism 37, a servomotor 83 fixed to the fixation plate 82, an elevatable unit 85 engaged with a rotary shaft 84 (specifically, a screw part) of the servomotor 83 and attached to the first air cylinder 58 via an elevation support part 87, and an elevation rail 88 slidably engaged with the elevatable unit 85 and guiding the elevatable unit 85 in the height direction (i.e., Z direction).

The servomotor 83 includes the rotary shaft 84 having a central axis extending in the height direction, and rotates the rotary shaft 84 by an intended number of rotations under the control of the control unit (see FIG. 5 which will be explained later). The screw part is formed on the rotary shaft 84, and the elevatable unit 85 is screwed onto the screw part. The elevation rail 88 is attached to the fixation plate 82 and extends in the height direction. The elevation rail 88 holds the elevatable unit 85 so that the elevatable unit 85 does not rotate together with the rotary shaft 84. The elevatable unit 85 moves in the height direction according to the rotation of the rotary shaft 84 of the servomotor 83 while being guided by the elevation rail 88. The first distance adjustment mechanism 57 and the first intermediate holding unit 48, which are attached to the elevatable unit 85 via the elevation support part 87, move up and down together with the elevatable unit 85. A shaft bearing 86 limits the ascending/descending movement (especially, the lowest position) of the elevatable unit 85 while rotatably holding the rotary shaft 84.

By the elevation mechanism 39 having the configuration described above, the first intermediate holding unit 48 is moved up and down in the height direction. The elevatable unit 85 and the first intermediate holding unit 48 are placed at intended elevation positions by elevation position control performed by the servomotor 83 (i.e., rotation number control of the rotary shaft 84). As above, the elevation position of the first intermediate holding unit 48 is regulated by the servo control of the servomotor 83. Therefore, even when the elevation position of the first intermediate holding unit 48 has to be modified, the first intermediate holding unit 48 can be appropriately placed at the intended elevation position by just modifying the control program and/or control data of the servomotor 83. For example, even when the elevation position (especially, the second elevation position) of the first intermediate holding unit 48 has to be modified due to the resizing of the packaging object 13 and/or the packaging bag 12, the elevation position of the first intermediate holding unit 48 can be adjusted with ease and in a short time.

Incidentally, while the second intermediate holding unit 49 is basically not provided to be able to ascend and descend in the insertion apparatus 10 shown in FIG. 1, the height direction position of the second intermediate holding unit 49 can be adjusted by the operator by manually operating a handle of an unshown adjustment unit. The second intermediate holding unit 49 may be provided to be able to ascend and descend. In such cases, the ascending and descending of the second intermediate holding unit 49 may be implemented by providing the second intermediate holding unit 49 with a mechanism similar to the above-described elevation mechanism 39.

[Second Pushing Mechanism]

The second pushing mechanism 36 functions as a second placement mechanism that moves the packaging object 13, on the first intermediate holding unit 48 at least partially placed in the packaging bag 12, in the horizontal direction (i.e., X direction) and thereby places the packaging object 13 outside the first intermediate holding unit 48 and inside the packaging bag 12. The second pushing mechanism 36 shown in FIG. 1 includes a second pushing member 123, a second motor 124, a second pivot block 125, a second lever 126, a second motor/lever connection rod 127, a second movement block 128, a second lever/block connection rod 129, a second slide block 130 and a second rail 131.

The second pushing member 123 is provided to be able to reciprocate in the horizontal direction (i.e., X direction) between a withdrawn position (see FIG. 9) separate from the packaging object 13 on the first intermediate holding unit 48 placed at the second elevation position and a pushing position (see FIG. 10) for contacting the packaging object 13 outside the first intermediate holding unit 48 and inside the packaging bag 12. The second pushing member 123 is provided to pass through a through hole 133 formed in the support plate 32, and thus the second pushing member 123 does not interfere with the support plate 32 even when reciprocating in the horizontal direction.

The second motor 124 is fixed to the mount 30 via a second motor attachment plate 132 and is connected to the second motor/lever connection rod 127 via the second pivot block 125. The second motor 124, as the drive source for the second pushing member 123, transmits motive power to the second lever 126 via the second pivot block 125 and the second motor/lever connection rod 127. The second pivot block 125 is provided stationarily with respect to a rotary shaft of the second motor 124 and to be pivotable with respect to the second motor/lever connection rod 127. The second motor/lever connection rod 127 is pivotably connected to the second pivot block 125 and the second lever 126. The second lever 126 is provided to be pivotable around the pivot shaft 71 shared with the first lever 69 and transmits the motive power supplied from the second motor 124 to the second movement block 128 via the second lever/block connection rod 129. The second lever/block connection rod 129 is pivotably connected to the second lever 126 and the second movement block 128. The second movement block 128 is fixed to the second slide block 130, and the second pushing member 123 is attached to the second slide block 130, and thus the second movement block 128, the second slide block 130 and the second pushing member 123 integrally reciprocate in the horizontal direction (i.e., X direction). The second movement block 128 is provided to be movable along the second rail 131 extending in the horizontal direction (i.e., X direction); however, movement of the second movement block 128 in other directions (e.g., the Y direction and the Z direction) is restricted. The second rail 131 is fixed to the support plate 32.

In the second pushing mechanism 36 having the configuration described above, the pivoting state of the second lever 126 around the pivot shaft 71 is changed by the motive power outputted from the second motor 124, and the position of the second pushing member 123 in regard to the horizontal direction (i.e., X direction) can be changed according to the pivoting state of the second lever 126. Incidentally, the second motor 124 is controlled by the control unit (see FIG. 5 which will be explained later), and the pivoting state of the second lever 126 and the position of the second pushing member 123 are regulated by the control unit.

[First Horizontal Movement Mechanism]

Figure 9:
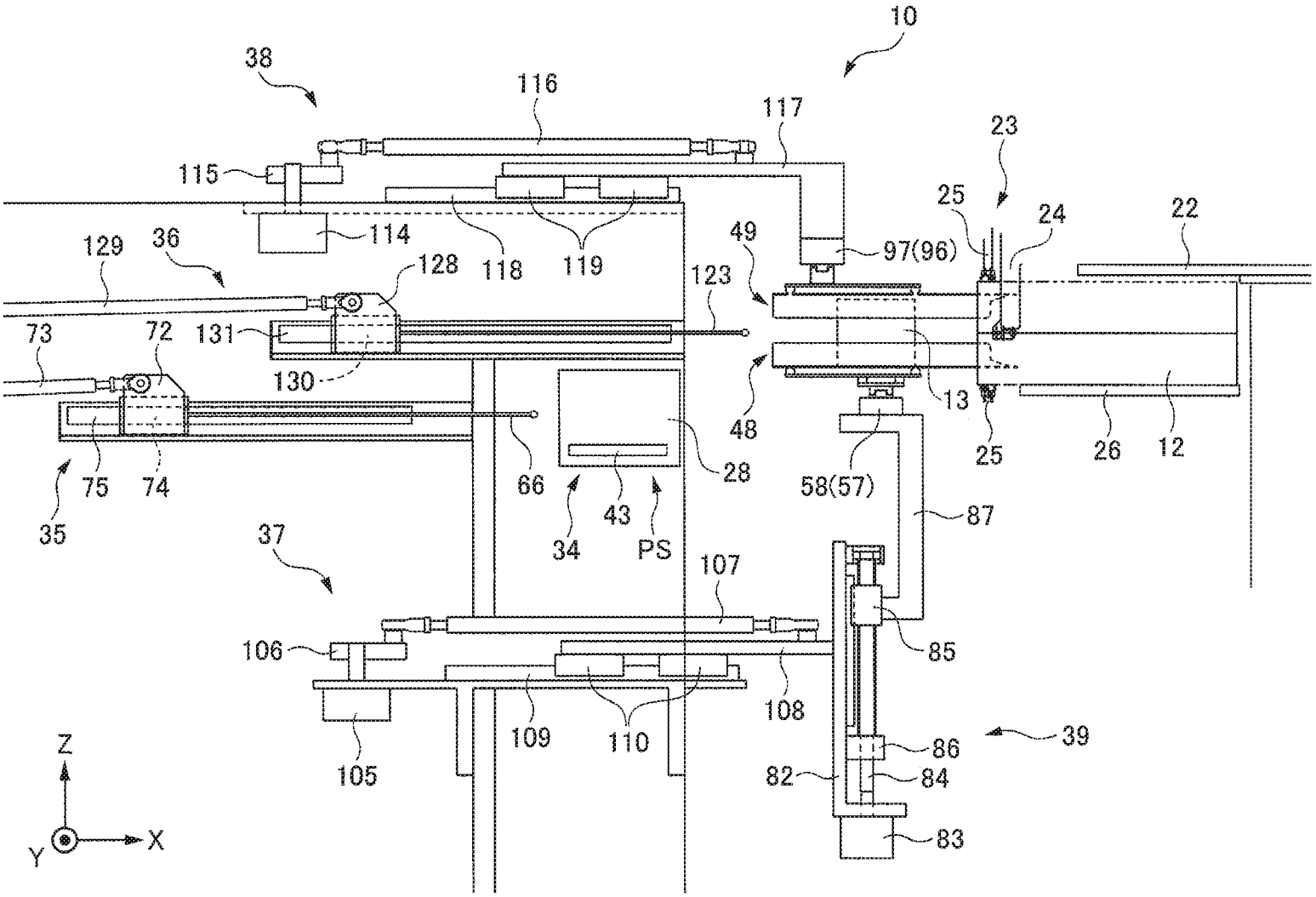
FIG. 9 is a diagram for explaining an operating state of the insertion apparatus.

The first horizontal movement mechanism 37 moves the first intermediate holding unit 48 placed at the second elevation position in the horizontal direction (i.e., X direction) and inserts at least a part of the first intermediate holding unit 48 into the packaging bag 12 via the bag mouth 12*a* as shown in FIG. 9 which will be explained later. The first horizontal movement mechanism 37 shown in FIG. 1 includes a third motor 105 fixed to the support plate 32, a third pivot block 106 fixed to a rotary shaft of the third motor 105, a third movement block 108 attached to the fixation plate 82 of the elevation mechanism 39, a first block connection rod 107 pivotably attached to the third pivot block 106 and the third movement block 108, a third slide block 110 fixed to the third movement block 108, and a third rail 109 for guiding the third slide block 110 in the horizontal direction (i.e., X direction).

The third motor 105 is controlled by the control unit (see FIG. 5 which will be explained later) and is capable of rotating to an intended angular position. The third rail 109 is fixed on the support plate 32 and extends in the horizontal direction (i.e., X direction). The third slide block 110 is provided to be slidable in the horizontal direction (I.e., X direction) along the third rail 109. The third movement block 108 moves in the horizontal direction (i.e., X direction) integrally with the third slide block 110 and the fixation plate 82.

In the first horizontal movement mechanism 37, the third pivot block 106 pivots according to the rotation of the rotary shaft of the third motor 105, the posture of the first block connection rod 107 is determined according to the pivoting posture of the third pivot block 106, and the X direction position of the third movement block 108 is determined according to the posture of the first block connection rod 107. The third movement block 108 is guided by the third rail 109 via the third slide block 110 and moves in the horizontal direction (i.e., X direction) together with the fixation plate 82. The fixation plate 82 is attached to the first distance adjustment mechanism 57 and the first intermediate holding unit 48 via the servomotor 83, the elevatable unit 85 and the elevation support part 87. Thus, the first distance adjustment mechanism 57 and the first intermediate holding unit 48 also move in the horizontal direction (i.e., X direction) together with the third movement block 108. As above, the first horizontal movement mechanism 37 moves the first intermediate holding unit 48 in the horizontal direction (i.e., X direction) via the elevation mechanism 39 and the first distance adjustment mechanism 57 and thereby moves the first intermediate holding unit 48 between an insertion position for the insertion into the packaging bag 12 and a withdrawn position outside the packaging bag 12. Incidentally, the first horizontal movement mechanism 37 is basically similar in mechanism to the second horizontal movement mechanism 38 shown in FIG. 4.

[Second Horizontal Movement Mechanism]

The second horizontal movement mechanism 38 moves the second intermediate holding unit 49 in the horizontal direction (i.e., X direction) and inserts at least a part of the second intermediate holding unit 49 into the packaging bag 12 via the bag mouth 12*a* as shown in FIG. 9 which will be explained later. The second horizontal movement mechanism 38 shown in FIG. 1 and FIG. 4 includes a fourth motor 114 fixed to the mount 30, a fourth pivot block 115 fixed to a rotary shaft of the fourth motor 114, a fourth movement block 117 attached to the second air cylinder 97, a second block connection rod 116 pivotably attached to the fourth pivot block 115 and the fourth movement block 117, a fourth slide block 119 fixed to the fourth movement block 117, and a fourth rail 118 for guiding the fourth slide block 119 in the horizontal direction (i.e., X direction).

The fourth motor 114 is controlled by the control unit (see FIG. 5 which will be explained later) and is capable of rotating to an intended angular position. The fourth rail 118 is fixed on the mount 30 and extends in the horizontal direction (i.e., X direction). The fourth slide block 119 is provided to be slidable in the horizontal direction (i.e., X direction) along the fourth rail 118. The fourth movement block 117 moves in the horizontal direction (i.e., X direction) integrally with the fourth slide block 119, the second distance adjustment mechanism 96 and the second intermediate holding unit 49.

In the second horizontal movement mechanism 38, the fourth pivot block 115 pivots according to the rotation of the rotary shaft of the fourth motor 114, the posture of the second block connection rod 116 is determined according to the pivoting posture of the fourth pivot block 115, and the X direction position of the fourth movement block 117 is determined according to the posture of the second block connection rod 116. The fourth movement block 117 is guided by the fourth rail 118 via the fourth slide block 119. The second intermediate holding unit 49 is attached to the fourth movement block 117 via the second distance adjustment mechanism 96, and thus moves in the horizontal direction (i.e., X direction) together with the fourth movement block 117. As above, the second horizontal movement mechanism 38 moves the second intermediate holding unit 49 in the horizontal direction (i.e., X direction) via the second distance adjustment mechanism 96 and thereby moves the second intermediate holding unit 49 between an insertion position for the insertion into the packaging bag 12 and a withdrawn position outside the packaging bag 12.

[Control Unit]

Figure 5:
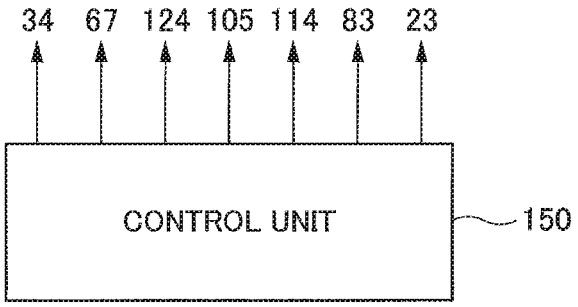
FIG. 5 is a block diagram showing a control unit.

FIG. 5 is a block diagram showing a control unit 150. The operation of the insertion apparatus 10 described above is controlled by the control unit 150. Specifically, the transfer mechanism 34, the first motor 67, the second motor 124, the third motor 105, the fourth motor 114, the servomotor 83 and the bag support units 23 are connected to the control unit 150 and controlled by the control unit 150. Therefore, the control unit 150 is capable of controlling the transfer of the packaging objects 13, the reciprocation of the first pushing member 66, the reciprocation of the second pushing member 123, the horizontal movement of the first intermediate holding unit 48, the horizontal movement of the second intermediate holding unit 49, the ascending and descending of the first intermediate holding unit 48, and the placement of the packaging bags 12 in a comprehensive manner.

The control unit 150 may be implemented by any type of hardware, software (including various programs and data) or combination of hardware and software. Thus, the control unit 150 may include a computer-readable nontemporary record medium storing programs and data for causing a computer to execute various processes and methods to be performed by the insertion apparatus 10 and a processor (computer) such as a CPU (Central Processing Unit) for performing data processing and outputting control signals.

[Operation of Insertion Apparatus]

Next, the concrete operation of the insertion apparatus 10 will be described below. As mentioned earlier, the insertion apparatus 10 operates under the control of the control unit 150.

FIG. 6 to FIG. 10 are diagrams for explaining operating states of the insertion apparatus 10.

Figure 6:
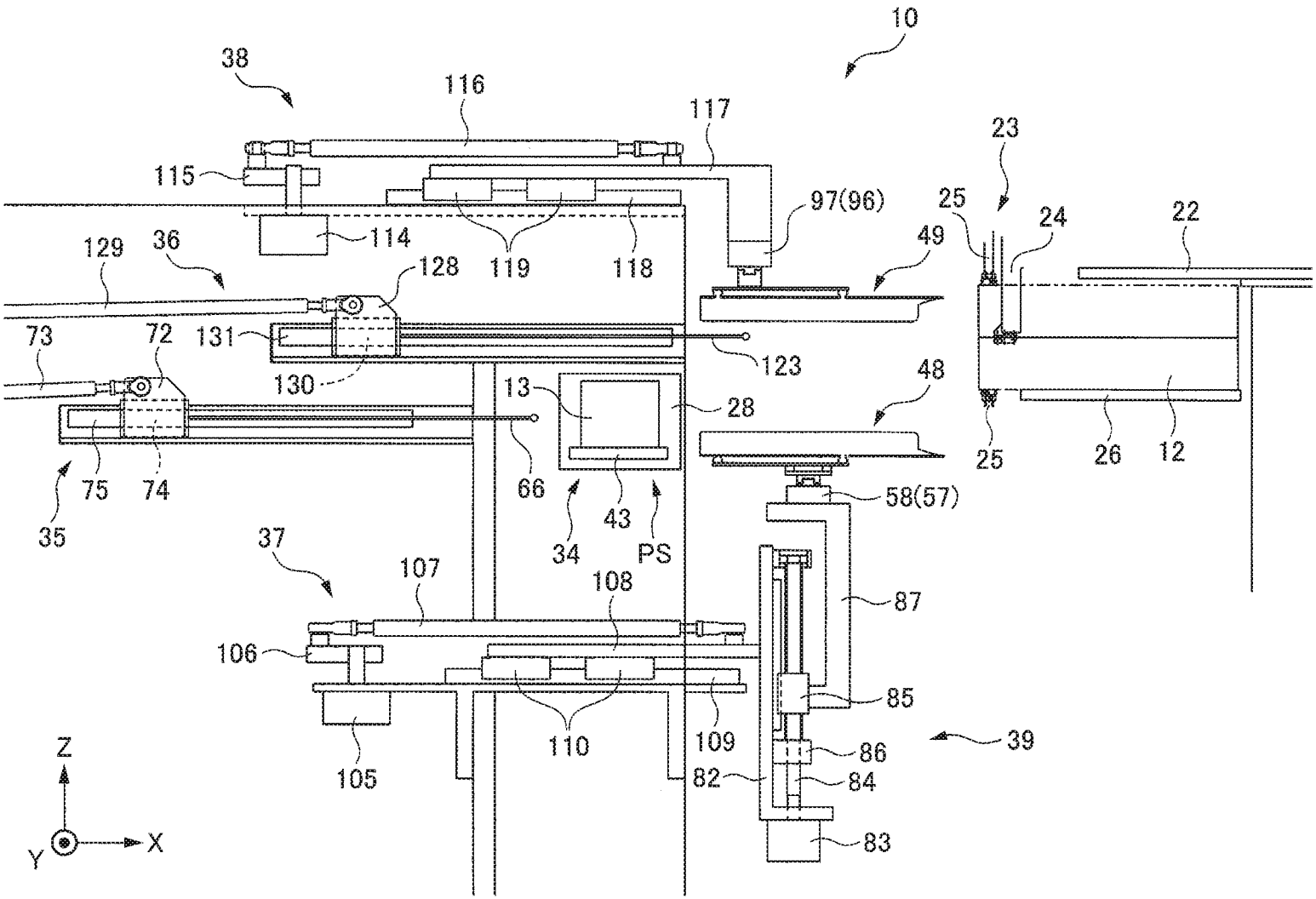
FIG. 6 is a diagram for explaining an operating state of the insertion apparatus.

First, as shown in FIG. 6, the packaging object 13 is placed at the supply position PS by the transfer mechanism 34. At that time, the first pushing member 66 has been placed at the withdrawn position.

Figure 7:
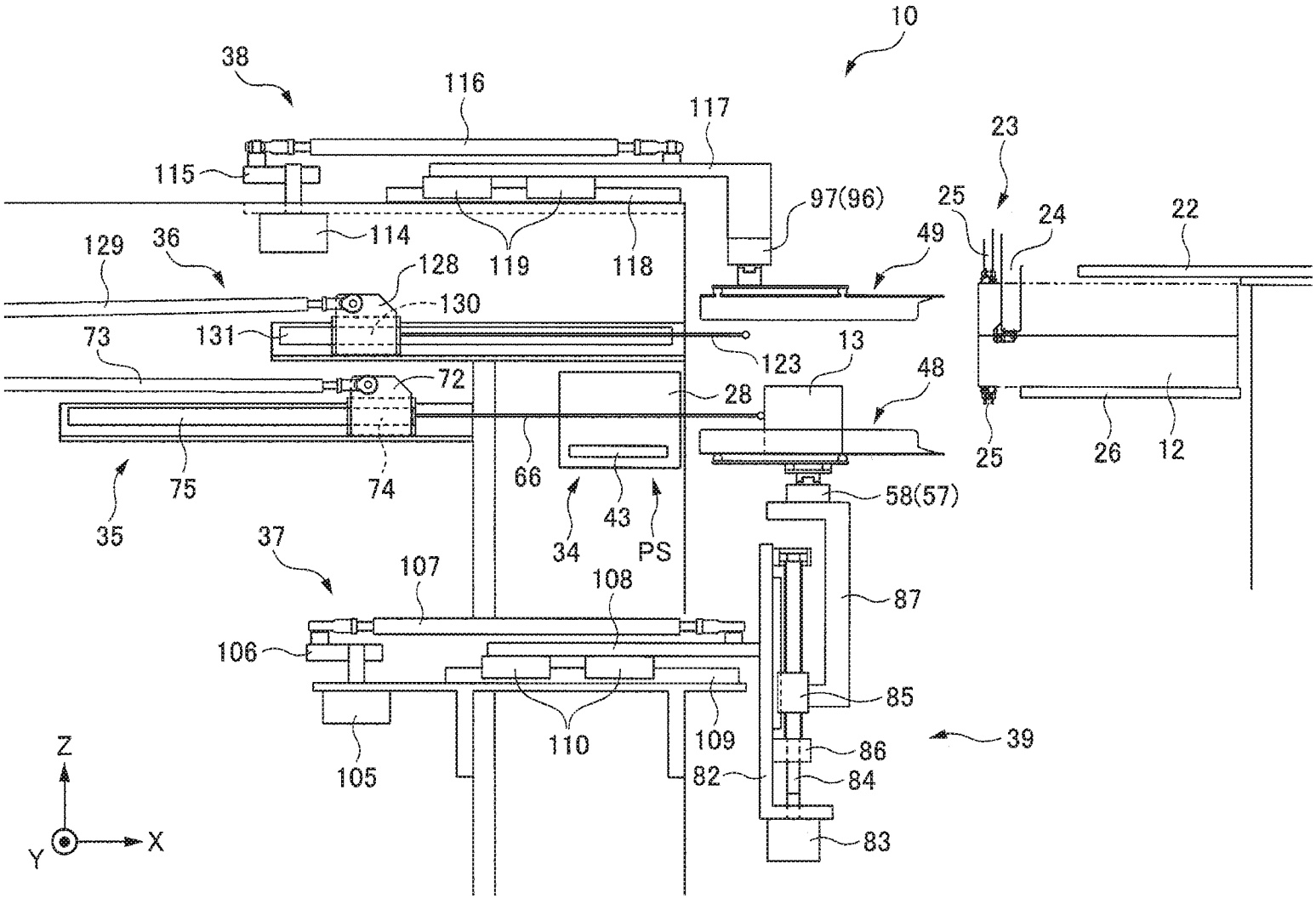
FIG. 7 is a diagram for explaining an operating state of the insertion apparatus.

Then, as shown in FIG. 7, the first pushing member 66 moves from the withdrawn position to the pushing position. Accordingly, the packaging object 13 on the transfer belt 43 placed at the supply position PS is pushed by the first pushing member 66 and moved from the position on the transfer belt 43 onto the first intermediate holding unit 48.

At that time, the first intermediate holding unit 48 has been placed at the first elevation position (I.e., lower position). Meanwhile, the first side guide part 52 and the second side guide part 53 have been placed at the open positions (see FIG. 3B) and the distance between the first side guide part 52 and the second side guide part 53 in the horizontal direction (i.e., Y direction) at the position closest to the supply position PS has been set larger than the size of the packaging object 13. Accordingly, the packaging object 13 can be smoothly transferred from the transfer belt 43 to the base support part 51 while preventing interference of the packaging object 13 with the first side guide part 52 or the second side guide part 53.

After the packaging object 13 is placed on the base support part 51, the first side guide part 52 and the second side guide part 53 are arranged at the closed positions (see FIG. 3A and FIG. 3C) by the first distance adjustment mechanism 57. Accordingly, the packaging object 13 on the base support part 51 is supported from both sides by the first side guide part 52 and the second side guide part 53. The first pushing member 66 is returned to the withdrawn position.

Figure 8:
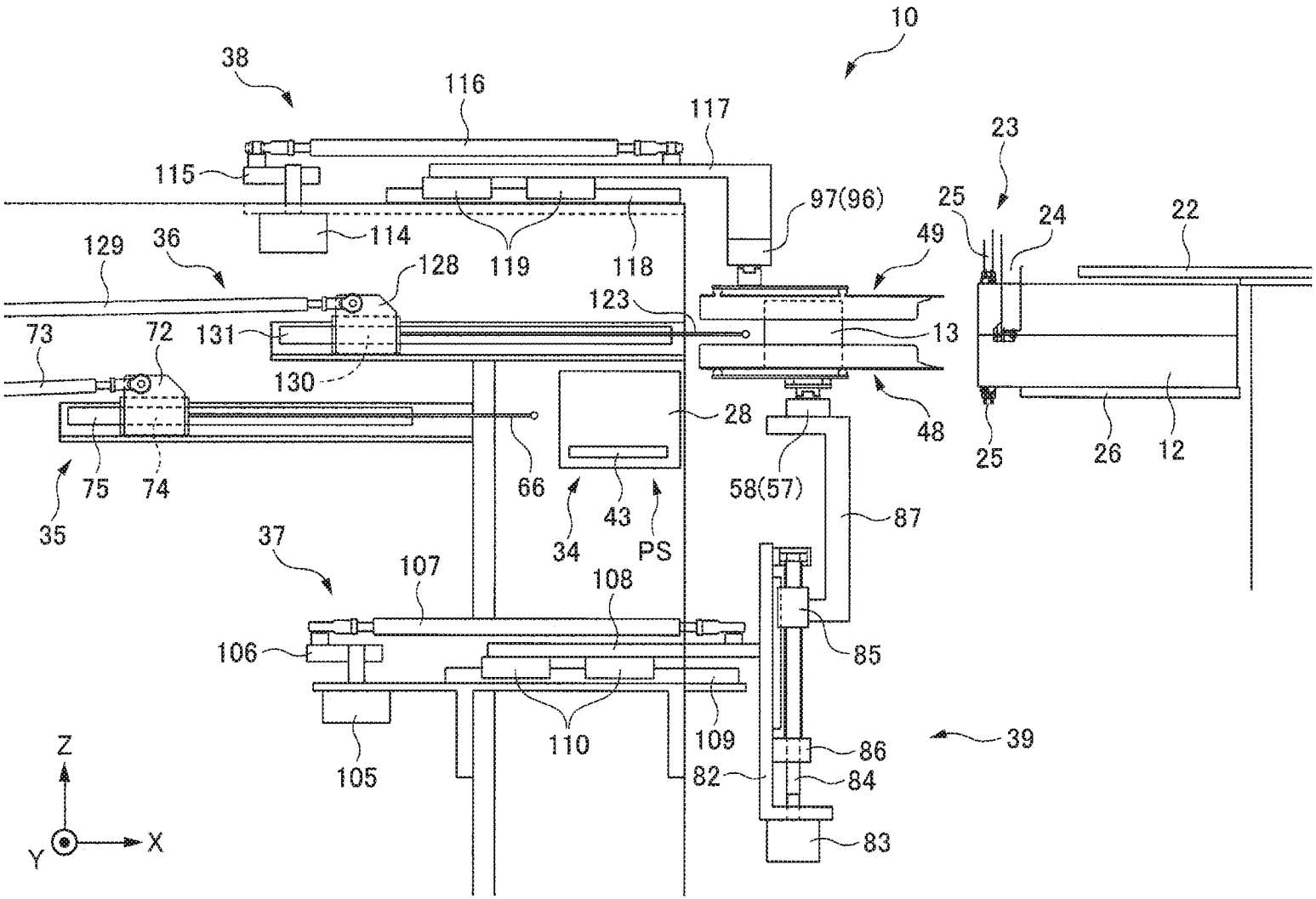
FIG. 8 is a diagram for explaining an operating state of the insertion apparatus.

Then, as shown in FIG. 8, the first intermediate holding unit 48 is elevated from the first elevation position to the second elevation position by the elevation mechanism 39, while the packaging object 13 on the first intermediate holding unit 48 is also elevated together with the first intermediate holding unit 48. Specifically, rotation control of the rotary shaft 84 of the servomotor 83 is performed under the control of the control unit 150 and the rotary shaft 84 is rotated by a rotation amount necessary for the elevation from the first elevation position to the second elevation position. Accordingly, the first intermediate holding unit 48 is precisely placed at the second elevation position. Incidentally, the elevation amount of the first intermediate holding unit 48 from the first elevation position to the second elevation position, that is, the rotation amount of the rotary shaft 84, has previously been determined according to the sizes of the packaging bag 12 (especially, the bag mouth 12*a*) and the packaging object 13.

At the point when the elevating operation of the first intermediate holding unit 48 shown in FIG. 8 is performed, the second pushing member 123 has been arranged at the withdrawn position and the third side guide part 93 and the fourth side guide part 94 have been arranged at the open positions (see FIG. 3C). Accordingly, the contact (i.e., interference) of the packaging object 13 on the first intermediate holding unit 48 with the second pushing member 123, the third side guide part 93 or the fourth side guide part 94 is prevented and the elevating operation of the packaging object 13 on first intermediate holding unit 48 is not impeded.

Thus, just after the elevation of the first intermediate holding unit 48 to the second elevation position, the first side guide part 52 and the second side guide part 53 have been arranged at the closed positions while the third side guide part 93 and the fourth side guide part 94 have been arranged at the open positions as shown in FIG. 3C. Accordingly, lower side parts of the packaging object 13 are supported by the first side guide part 52 and the second side guide part 53 and the height direction position of the packaging object 13 is regulated by the base support part 51 and the top plate part 92. In this embodiment, a slight gap is formed between the top plate part 92 and the packaging object 13 on the first intermediate holding unit 48 placed at the second elevation position, and thus the packaging object 13 on the first intermediate holding unit 48 is allowed to move smoothly when pushed in the horizontal direction.

After the first intermediate holding unit 48 is placed at the second elevation position together with the packaging object 13, the third side guide part 93 and the fourth side guide part 94 are arranged at the closed positions (see FIG. 3A) by the second distance adjustment mechanism 96. Accordingly, upper side parts of the packaging object 13 on the base support part 51 are supported by the third side guide part 93 and the fourth side guide part 94.

Then, as shown in FIG. 9, a part of the first intermediate holding unit 48 is inserted into the packaging bag 12 by the first horizontal movement mechanism 37, while a part of the second intermediate holding unit 49 is inserted into the packaging bag 12 by the second horizontal movement mechanism 38. Specifically, the rotary shafts of the third motor 105 and the fourth motor 114 are rotated by 180 degrees under the control of the control unit 150, by which the third movement block 108 and the fourth movement block 117 are moved in the horizontal direction (i.e., X direction) to approach the packaging bag 12.

At that time, the height direction position of the first intermediate holding unit 48 has been maintained at the same position as the second elevation position and the bag mouth 12*a* of the packaging bag 12 held by the bag support unit 23 has been maintained in the open state. Further, the distance between the first side guide part 52 and the second side guide part 53 has been adjusted by the first distance adjustment mechanism 57 so that the width (especially, the width of the outer parts) of the first side guide part 52 and the second side guide part 53 in the horizontal direction (i.e., Y direction) at least at the end on the packaging bag's side to be inserted into the packaging bag 12 is smaller than the size of the bag mouth 12*a* in the same direction. Similarly, the distance between the third side guide part 93 and the fourth side guide part 94 has been adjusted by the second distance adjustment mechanism 96 so that the width (especially, the width of the outer parts) of the third side guide part 93 and the fourth side guide part 94 in the horizontal direction (i.e., Y direction) at least at the end on the packaging bag's side to be inserted into the packaging bag 12 is smaller than the size of the bag mouth 12*a* in the same direction.

Then, in the state in which a part of the first intermediate holding unit 48 and a part of the second intermediate holding unit 49 have been placed in the packaging bag 12, the pressure of air supplied to the first air cylinder 58 and the second air cylinder 97 is weakened, or the first air cylinder 58 and the second air cylinder 97 are opened to the atmosphere. Accordingly, position retention force applied from the first distance adjustment mechanism 57 to the first side guide part 52 and the second side guide part 53 is weakened or reduced to zero (0) and position retention force applied from the second distance adjustment mechanism 96 to the third side guide part 93 and the fourth side guide part 94 is weakened or reduced to zero (0).

Figure 10:
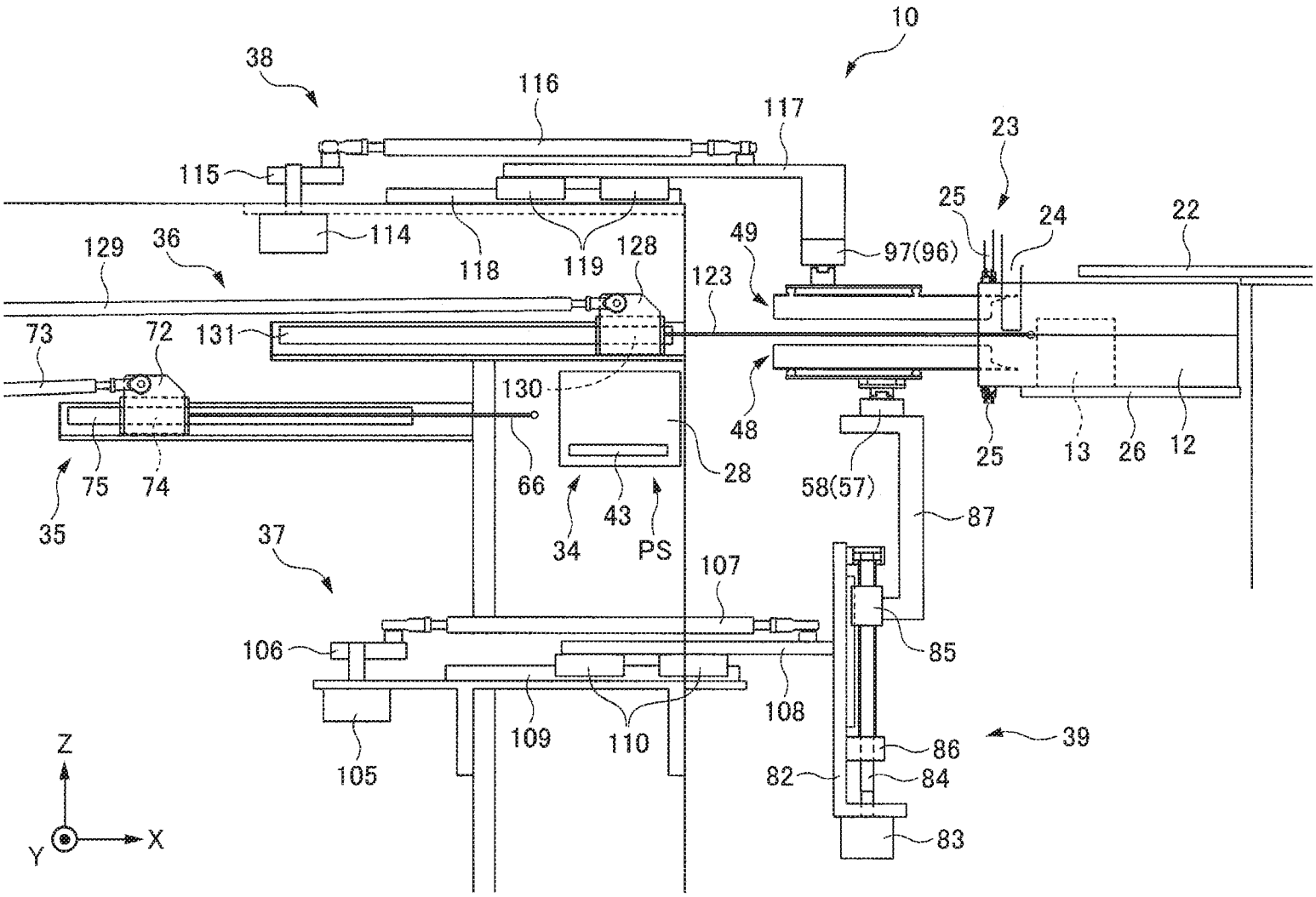
FIG. 10 is a diagram for explaining an operating state of the insertion apparatus.

Then, as shown in FIG. 10, the second pushing member 123 moves from the withdrawn position to the pushing position. Accordingly, the packaging object 13 on the first intermediate holding unit 48 is pushed by the second pushing member 123 and moved from the position on the first intermediate holding unit 48 to the inside of the packaging bag 12 (specifically, the vicinity of the bottom of the packaging bag 12) outside the first intermediate holding unit 48.

At that time, the packaging object 13 is pushed towards the inside of the packaging bag 12 while pressing the first side guide part 52, the second side guide part 53, the third side guide part 93 and the fourth side guide part 94 outward (i.e., in the Y direction) from inside. Meanwhile, the position retention force applied from the first distance adjustment mechanism 57 to each of the first side guide part 52 and the second side guide part 53 and the position retention force applied from the second distance adjustment mechanism 96 to each of the third side guide part 93 and the fourth side guide part 94 are maintained in the weakened state or the zero (0) state.

Thus, according to the movement of the packaging object 13 by the second pushing member 123, the first side guide part 52 and the second side guide part 53 are gradually separated from each other, the third side guide part 93 and the fourth side guide part 94 are gradually separated from each other, and the distance between the first side guide part 52 and the second side guide part 53 and the distance between the third side guide part 93 and the fourth side guide part 94 increase gradually. Accordingly, the packaging object 13 is pushed out by the second pushing member 123 and moves on the base support part 51 while being supported from both sides by the first side guide part 52, the second side guide part 53, the third side guide part 93 and the fourth side guide part 94. Therefore, it is possible to guide the packaging object 13 from the position on the first intermediate holding unit 48 to the inside of the packaging bag 12 outside the first intermediate holding unit 48 while appropriately maintaining the posture of the packaging object 13. Further, the inner surface of the packaging bag 12 is supported by the first side guide part 52, the second side guide part 53, the third side guide part 93 and the fourth side guide part 94 and the opening shape of the bag mouth 12*a* of the packaging bag 12 is maintained.

Thereafter, the second pushing member 123, the first intermediate holding unit 48 and the second intermediate holding unit 49 are withdrawn to the outside of the packaging bag 12, a new packaging object 13 is placed at the supply position PS by the transfer belt 43, a new packaging bag 12 is supported by the bag support unit 23, and the insertion apparatus 10 is returned again to the state shown in FIG. 6. New packaging objects 13 are inserted and placed in new packaging bags 12 by repeating the above-described process shown in FIG. 6 to FIG. 10.

[Arrangement of Side Guide Parts]

Figure 11A:
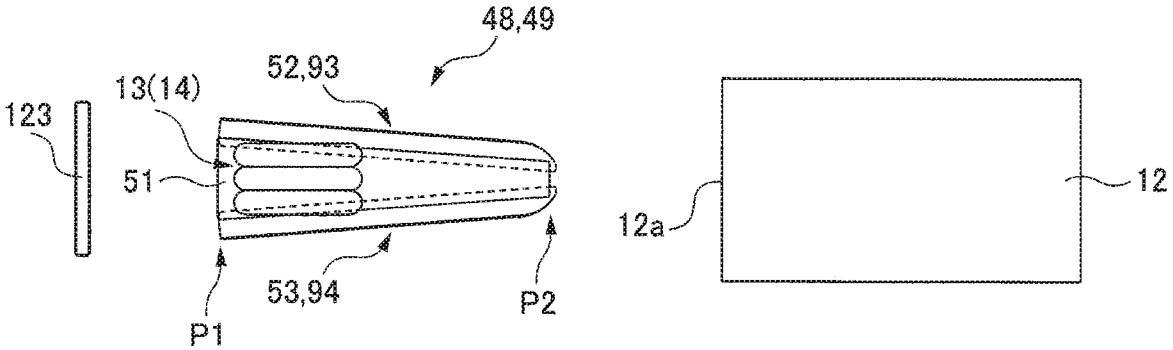
FIGS. 11A to 11C are plan views showing states of a first side guide part, a second side guide part, a third side guide part and a fourth side guide part, where
Figure 11B:
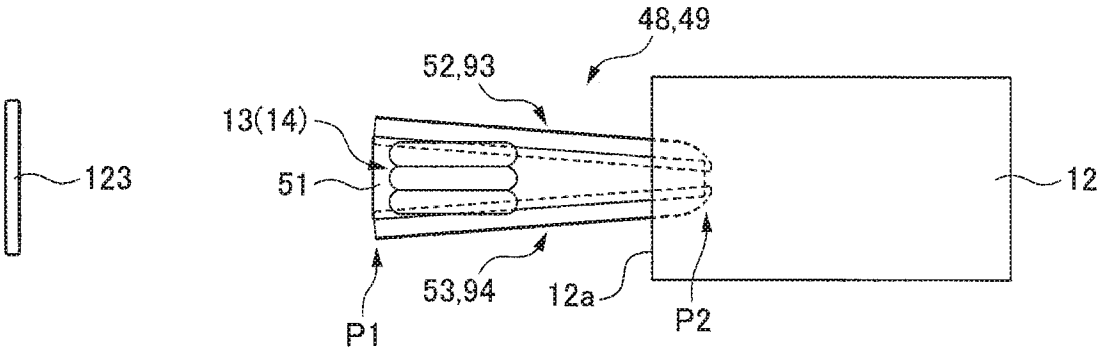
Figure 11C:
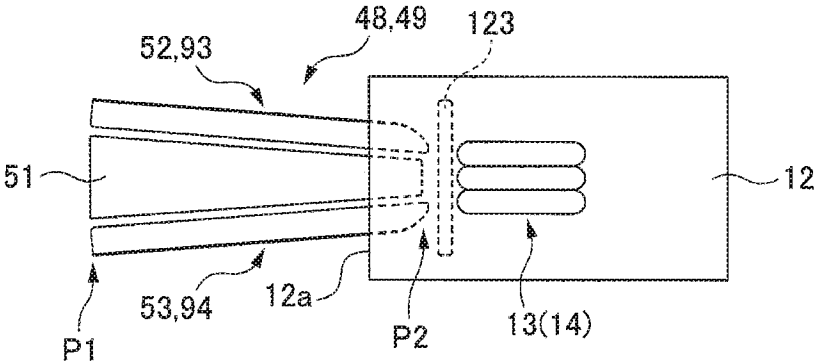

FIGS. 11A to 11C are plan views showing states of the first side guide part 52, the second side guide part 53, the third side guide part 93 and the fourth side guide part 94, where FIG. 11A shows a state just before the first intermediate holding unit 48 and the second intermediate holding unit 49 are inserted into the packaging bag 12, FIG. 11B shows a state just after the first intermediate holding unit 48 and the second intermediate holding unit 49 are inserted into the packaging bag 12, and FIG. 11C shows a state just after the packaging object 13 is pushed out by the second pushing member 123 to the inside of the packaging bag 12. Incidentally, illustration of the top plate part 92 is omitted in FIGS. 11A to 11C in order to facilitate the understanding.

As mentioned earlier, the distance between the first side guide part 52 and the second side guide part 53 and the distance between the third side guide part 93 and the fourth side guide part 94 decrease with the increase in the distance from the transfer belt 43 (i.e., with the decrease in the distance from the packaging bag 12).

The distance between the first side guide part 52 and the second side guide part 53 arranged at the closed positions (see FIGS. 11A and 11B) satisfies the following conditions: Specifically, the distance between the first side guide part 52 and the second side guide part 53 at the ends closest to the supply position PS (see the reference character "P1" In FIGS. 11A and 11B) is larger than the width (i.e., width in the Y direction) of the packaging object 13. Further, the distance between the first side guide part 52 and the second side guide part 53 at the ends closest to the packaging bag 12 (see the reference character "P2" in FIGS. 11A and 11B) is smaller than the width (i.e., width in the Y direction) of the packaging object 13. Furthermore, the width (especially, the width of the outer parts) of the first side guide part 52 and the second side guide part 53 at the ends closest to the packaging bag 12 (see the reference character "P2" in FIGS. 11A and 11B) is smaller than the size (i.e., size in the Y direction) of the bag mouth 12*a* of the packaging bag 12. Moreover, the distance between the first side guide part 52 and the second side guide part 53 becomes equal to the width (i.e., width in the Y direction) of the packaging object 13 at positions where the distance from the ends of the first side guide part 52 and the second side guide part 53 closest to the supply position PS (see the reference character "P1" in FIGS. 11A and 11B) is larger than the size of the packaging object 13 in its longitudinal direction (i.e., size in the X direction).

Similarly, the distance between the third side guide part 93 and the fourth side guide part 94 arranged at the closed positions (see FIGS. 11A and 11B) satisfies the following conditions: Specifically, the distance between the third side guide part 93 and the fourth side guide part 94 at the ends closest to the supply position PS (see the reference character "P1" in FIGS. 11A and 11B) is larger than the width (i.e., width in the Y direction) of the packaging object 13. Further, the distance between the third side guide part 93 and the fourth side guide part 94 at the ends closest to the packaging bag 12 (see the reference character "P2" in FIGS. 11A and 11B) is smaller than the width (i.e., width in the Y direction) of the packaging object 13. Furthermore, the width (especially, the width of the outer parts) of the third side guide part 93 and the fourth side guide part 94 at the ends closest to the packaging bag 12 (see the reference character "P2" in FIGS. 11A and 11B) is smaller than the size (i.e., size in the Y direction) of the bag mouth 12*a* of the packaging bag 12. Moreover, the distance between third side guide part 93 and the fourth side guide part 94 becomes equal to the width (i.e., width in the Y direction) of the packaging object 13 at positions where the distance from the ends of the third side guide part 93 and the fourth side guide part 94 closest to the supply position PS (see the reference character "P1" in FIGS. 11A and 11B) is larger than the size of the packaging object 13 in its longitudinal direction (i.e., size in the X direction).

With the configuration described above, the first side guide part 52, the second side guide part 53, the third side guide part 93 and the fourth side guide part 94 placed at the closed positions are arranged to surround the packaging object 13 and are capable of stably supporting the packaging object 13 (see FIGS. 11A and 11B). Further, the first intermediate holding unit 48 and the second intermediate holding unit 49 can be smoothly inserted into the packaging bag 12 via the bag mouth 12*a* (see FIG. 11B) by just moving the first intermediate holding unit 48 and the second intermediate holding unit 49 in the horizontal direction.

On the other hand, the distance between the first side guide part 52 and the second side guide part 53 arranged at the open positions (see FIG. 11C) is determined based on the following conditions: Specifically, the distance between the first side guide part 52 and the second side guide part 53 is larger than or equal to the width (i.e., width in the Y direction) of the packaging object 13 at all positions. Especially, the distance between the first side guide part 52 and the second side guide part 53 at the ends closest to the packaging bag 12 (see the reference character "P2" in FIG. 11C) is desired to be formed by the passage of the packaging object 13 between the ends (P2) and to coincide with the width (i.e., width in the Y direction) of the packaging object 13. Further, the distance between the first side guide part 52 and the second side guide part 53 at the ends closest to the supply position PS (see the reference character "P1" in FIG. 11C) is desired to be larger than the width (I.e., width in the Y direction) of the packaging object 13 placed on the transfer belt 43 at the supply position PS (see FIG. 2). Furthermore, the width (especially, the width of outer parts) of the parts of the first side guide part 52 and the second side guide part 53 placed inside the packaging bag 12 (see FIG. 11C) in the horizontal direction (i.e., Y direction) is smaller than or equal to the size of the bag mouth 12*a* in the same direction.

Similarly, the distance between the third side guide part 93 and the fourth side guide part 94 arranged at the open positions (see FIG. 11C) is determined based on the following conditions: Specifically, the distance between the third side guide part 93 and the fourth side guide part 94 is larger than or equal to the width (i.e., width in the Y direction) of the packaging object 13 at all positions. Especially, the distance between the third side guide part 93 and the fourth side guide part 94 at the ends closest to the packaging bag 12 (see the reference character "P2" in FIG. 11C) is desired to be formed by the passage of the packaging object 13 between the ends (P2) and to coincide with the width (i.e., width in the Y direction) of the packaging object 13. Further, the distance between the third side guide part 93 and the fourth side guide part 94 at the ends closest to the supply position PS (see the reference character "P1" in FIG. 11C) is desired to be larger than the width (i.e., width in the Y direction) of the packaging object 13 placed on the transfer belt 43 at the supply position PS (see FIG. 2). Furthermore, the width (especially, the width of outer parts) of the parts of the third side guide part 93 and the fourth side guide part 94 placed inside the packaging bag 12 (see FIG. 11C) in the horizontal direction (i.e., Y direction) is smaller than or equal to the size of the bag mouth 12*a* in the same direction.

With the configuration described above, when the packaging object 13 is pushed out by the second pushing member 123 to the inside of the packaging bag 12, the distance between the first side guide part 52 and the second side guide part 53 and the distance between the third side guide part 93 and the fourth side guide part 94 can be widened without being impeded by the bag mouth 12*a*. Accordingly, the packaging object 13 can be smoothly pushed out by the second pushing member 123 to the inside of the packaging bag 12.

Further, when the insertion apparatus 10 is rearranged to the state of FIG. 6 after the packaging object 13 is pushed out to the inside of the packaging bag 12 as shown in FIG. 10 and FIG. 11C, it is unnecessary to adjust the positions of the first side guide part 52, the second side guide part 53, the third side guide part 93 and the fourth side guide part 94 (i.e., the distance between the first side guide part 52 and the second side guide part 53 and the distance between the third side guide part 93 and the fourth side guide part 94). Specifically, the first side guide part 52, the second side guide part 53, the third side guide part 93 and the fourth side guide part 94 are arranged at the open positions shown in FIG. 11C by pushing out the packaging object 13 with the second pushing member 123 to the inside of the packaging bag 12 in the state in which the first side guide part 52, the second side guide part 53, the third side guide part 93 and the fourth side guide part 94 are receiving no force from the first distance adjustment mechanism 57 or the second distance adjustment mechanism 96. Then, the second intermediate holding unit 49 is returned to the withdrawn position and the first intermediate holding unit 48 is returned to the first elevation position while the first side guide part 52, the second side guide part 53, the third side guide part 93 and the fourth side guide part 94 are maintained at the open positions. Accordingly, the first side guide part 52, the second side guide part 53, the third side guide part 93 and the fourth side guide part 94 are arranged at the initial positions shown in FIG. 6 without the need of making position adjustment.

As described above, with the insertion apparatus 10 according to this embodiment, the height direction position of the packaging object 13 is adjusted by the first intermediate holding unit 48. Thus, even when the packaging object 13 and the packaging bag 12 to be used are changed, the packaging object 13 can be appropriately placed in the packaging bag 12 by moving the packaging object 13 in the horizontal direction in the state in which the height direction positions of the packaging object 13 and the packaging bag 12 have been made to correspond to each other. This is extremely convenient since the operator does not need to adjust the relative position between the packaging bag 12 and the packaging object 13 by manual operation.

Further, since the elevation position (especially, the second elevation position) of the first intermediate holding unit 48 can be adjusted by the rotation number control of the rotary shaft 84 of the servomotor 83, the adjustment of the elevation position of the first intermediate holding unit 48 can be made with precision and ease. An intended packaging object 13 can be appropriately inserted and placed in an intended packaging bag 12 by adjusting the elevation amount and the elevation position of the first intermediate holding unit 48 by use of the servomotor 83 according to the sizes of the packaging object 13 and the packaging bag 12 to be used.

Furthermore, each of the first intermediate holding unit 48 and the second intermediate holding unit 49 has the separate structure and is provided so that the distance between the first side guide part 52 and the second side guide part 53 and the distance between the third side guide part 93 and the fourth side guide part 94 are adjustable. This makes it possible to appropriately support packaging objects 13 of various sizes and appropriately insert and place the packaging objects 13 in packaging bags 12 of various sizes. Thus, even when the sizes of the packaging bag 12 and the packaging object 13 have been changed, the resized packaging bags 12 and packaging objects 13 can be handled without the need of manually adjusting the positions of the side guide parts of the first intermediate holding unit 48 and the second intermediate holding unit 49 or replacing the first intermediate holding unit 48 and the second intermediate holding unit 49.

Moreover, the state in which the bag mouth 12*a* is stably open can be maintained desirably since the packaging object 13 is pushed out by the second pushing member 123 to the inside of the packaging bag 12 while keeping parts of the first intermediate holding unit 48 and the second intermediate holding unit 49 inserted in the packaging bag 12.

The present invention is not limited to the above-described embodiments and modifications. For example, various modifications may be made to elements of the above-described embodiments and modifications. Further, modes including a component and/or a method other than the components or methods described above are also included in the embodiments of the present invention. Furthermore, modes not including part of the components or methods described above are also included in the embodiments of the present invention. Moreover, modes including part of components and/or methods included in an embodiment of the present invention and part of components and/or methods included in another embodiment of the present invention are also included in the embodiments of the present invention. Accordingly, it is possible to combine components and/or methods included in the above-described embodiments and modifications and other undescribed embodiments of the present invention, and modes in regard to such combinations are also included in the embodiments of the present invention. Effects achieved by the present invention are also not restricted to those described above; specific effects corresponding to the specific configuration of each embodiment can also be achieved. As above, various additions, changes and partial deletions can be made to the elements described in the claims, specification, abstract and drawings within the range not departing from the technical idea and content of the present invention.

The invention claimed is:

1. An insertion apparatus for placing a packaging object in a packaging bag, the insertion apparatus comprising:

a bag support unit that holds the packaging bag in a state where a bag mouth of the packaging bag is opened;

a transfer mechanism that places the packaging object at a supply position;

a first intermediate holding unit provided to be able to ascend and descend;

an elevation mechanism that elevates or lowers the first intermediate holding unit so as to place the first intermediate holding unit at a first elevation position and a second elevation position;

a first placement mechanism that moves the packaging object placed at the supply position in a horizontal direction so as to place the packaging object on the first intermediate holding unit placed at the first elevation position;

a horizontal movement mechanism that moves the first intermediate holding unit placed at the second elevation position in the horizontal direction so as to insert at least a part of the first intermediate holding unit in the packaging bag via the bag mouth;

a second placement mechanism that moves the packaging object, when placed on the first intermediate holding unit and the first intermediate holding unit is at least partially placed in the packaging bag, in the horizontal direction so as to place the packaging object inside the packaging bag;

a second intermediate holding unit provided above the first intermediate holding unit, the second intermediate holding unit includes a third side guide part and a fourth side guide part that are configured to support the packaging object on the first intermediate holding unit when placed at the second elevation position, wherein a distance between the third side guide part and the fourth side guide part of the second intermediate holding unit in a horizontal direction is adjustable; and a distance adjustment mechanism configured to adjust the distance between the third side guide part and the fourth side guide part to regulate a position of the packaging object on the first intermediate holding unit when placed at the second elevation position so as to prevent a change in a posture of the packaging object.

2. The insertion apparatus according to claim 1, wherein the first intermediate holding unit includes:

a base support part on which the packaging object is placed; and a first side guide part and a second side guide part between which the packaging object on the base support part is arranged, distance between the first side guide part and the second side guide part in the horizontal direction being adjustable, and wherein the insertion apparatus further comprises a first distance adjustment mechanism that adjusts the distance between the first side guide part and the second side guide part according to a position of the packaging object on the base support part.

3. The insertion apparatus according to claim 2, wherein the first side guide part and the second side guide part of the first intermediate holding unit are arranged such that the distance between the first side guide part and the second side guide part in the horizontal direction decreases with increase in distance of the packaging object from the supply position, and wherein, while the packaging object is moved from the supply position onto the first intermediate holding unit when the first intermediate holding unit is placed at the first elevation position, the distance between the first side guide part and the second side guide part in the horizontal direction at a position closest to the supply position of the packaging object is larger than a size of the packaging object placed at the supply position in the horizontal direction, and the distance between the first side guide part and the second side guide part in the horizontal direction at a position farthest from the supply position of the packaging object is smaller than the size of the packaging object placed at the supply position in the horizontal direction.

4. The insertion apparatus according to claim 3, wherein, while the first intermediate holding unit is moved by the horizontal movement mechanism, the distance between the first side guide part and the second side guide part in the horizontal direction at a position farthest from the supply position is smaller than a size of the bag mouth of the packaging bag held by the bag support unit in the horizontal direction, and wherein the at least a part of the first intermediate holding unit inserted into the packaging bag by the horizontal movement mechanism includes an end of the first side guide part and an end of the second side guide part that are at positions farthest from the supply position of the packaging object.

5. The insertion apparatus according to claim 4, wherein the first distance adjustment mechanism biases at least one of the first side guide part and the second side guide part in a direction for making the first side guide part and the second side guide part approach each other so as to adjust the distance between the first side guide part and the second side guide part, and wherein, while the second placement mechanism moves the packaging object on the first intermediate holding unit, the first distance adjustment mechanism is configured to allow the packaging object to press the first side guide part and the second side guide part outward and increase the distance between the first side guide part and the second side guide part.

6. The insertion apparatus according to claim 3, wherein the first distance adjustment mechanism biases at least one of the first side guide part and the second side guide part in a direction for making the first side guide part and the second side guide part approach each other so as to adjust the distance between the first side guide part and the second side guide part, and wherein, while the second placement mechanism moves the packaging object on the first intermediate holding unit, the first distance adjustment mechanism is configured to allow the packaging object to press the first side guide part and the second side guide part outward and increase the distance between the first side guide part and the second side guide part.

7. The insertion apparatus according to claim 2, wherein, while the first intermediate holding unit is moved by the horizontal movement mechanism, the distance between the first side guide part and the second side guide part in the horizontal direction at a position farthest from the supply position is smaller than a size of the bag mouth of the packaging bag held by the bag support unit in the horizontal direction, and wherein the at least a part of the first intermediate holding unit inserted into the packaging bag by the horizontal movement mechanism includes an end of the first side guide part and an end of the second side guide part that are at positions farthest from the supply position of the packaging object.

8. The insertion apparatus according to claim 7, wherein the first distance adjustment mechanism biases at least one of the first side guide part and the second side guide part in a direction for making the first side guide part and the second side guide part approach each other so as to adjust the distance between the first side guide part and the second side guide part, and wherein, while the second placement mechanism moves the packaging object on the first intermediate holding unit, the first distance adjustment mechanism is configured to allow the packaging object to press the first side guide part and the second side guide part outward and increase the distance between the first side guide part and the second side guide part.

9. The insertion apparatus according to claim 2, wherein the first distance adjustment mechanism biases at least one of the first side guide part and the second side guide part in a direction for making the first side guide part and the second side guide part approach each other so as to adjust the distance between the first side guide part and the second side guide part, and wherein, while the second placement mechanism moves the packaging object on the first intermediate holding unit, the first distance adjustment mechanism is configured to allow the packaging object to press the first side guide part and the second side guide part outward and increase the distance between the first side guide part and the second side guide part.

10. The insertion apparatus according to claim 1, wherein the distance adjustment mechanism is a second distance adjustment mechanism, wherein, after the first intermediate holding unit moves from the first elevation position to the second elevation position and before the at least a part of the first intermediate holding unit is inserted in the packaging bag, the second distance adjustment mechanism decreases the distance between the third side guide part and the fourth side guide part such that the third side guide part and the fourth side guide part regulate the position of the packaging object on the first intermediate holding unit.

11. The insertion apparatus according to claim 1, wherein the packaging object includes a plurality of articles, and wherein the plurality of articles included in the packaging object are arranged in a state of being aligned in the horizontal direction on the first intermediate holding unit.

12. The insertion apparatus according to claim 1, wherein the second elevation position is determined according to a size of the packaging object in a vertical height direction and a position of the bag mouth of the packaging bag held by the bag support unit in the vertical height direction.

* * * * *